US007416034B2

(12) United States Patent
Downie et al.

(10) Patent No.: US 7,416,034 B2
(45) Date of Patent: Aug. 26, 2008

(54) DRIVE SYSTEM

(75) Inventors: Andrew McPherson Downie, Fife (GB); Guido Ernesto Pezzani, Clackmannanshire (GB)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 10/311,705

(22) PCT Filed: Jun. 15, 2001

(86) PCT No.: PCT/GB01/02679

§ 371 (c)(1),
(2), (4) Date: Aug. 12, 2003

(87) PCT Pub. No.: WO01/98619

PCT Pub. Date: Dec. 27, 2001

(65) Prior Publication Data

US 2004/0026129 A1 Feb. 12, 2004

(30) Foreign Application Priority Data

Jun. 17, 2000 (GB) ..... 0014776.9

(51) Int. Cl.
*E21B 4/02* (2006.01)
*E21B 17/00* (2006.01)

(52) U.S. Cl. ..... 175/107; 175/106; 415/903

(58) Field of Classification Search ..... 175/106, 175/107; 415/903
See application file for complete search history.

(56) References Cited

U.S. PATENT DOCUMENTS 2,626,780 A * 1/1953 Ortloff ..... 175/107
2,654,572 A * 10/1953 Arutunoff ..... 175/102
2,990,895 A 7/1961 Works et al.
3,365,170 A 1/1968 Whittle (Continued)

FOREIGN PATENT DOCUMENTS

CA 1 257 865 7/1989

(Continued)

OTHER PUBLICATIONS

International Search Report for PCT/GB01/02679 completed Oct. 3, 2001.

(Continued)

*Primary Examiner*—Shane Bomar
(74) *Attorney, Agent, or Firm*—Alston & Bird LLP

(57) ABSTRACT

The invention relates to a drive system, in particular a downhole drilling assembly (10). In the preferred embodiment, a bearing mechanism (14, 24) of the assembly (10) is isolated from a gear mechanism (20) of the assembly (10), to prevent failure of the bearing mechanism (14, 24) due to vibration and heat generated by the gear mechanism (20) in use. A lower bearing unit (24) of the bearing mechanism (24) is coupled to the gear mechanism (20) by a shock eliminating coupling assembly (22), which prevents the transmission of shock loads to the gear mechanism (20). Also, the gear mechanism (20) is coupled through a shock eliminating coupling assembly (18) to a turbine (16) and thus to an upper bearing unit (14). Sealing assemblies (60, 116) are provided for the gear mechanism (20) and the upper bearing unit (14) to prevent drilling fluid ingress and consequent damage. The assembly (10) may also carry a torsionally flexible drive shaft (46).

26 Claims, 13 Drawing Sheets

U.S. PATENT DOCUMENTS

| | | | |
|---|---|---|---|
| 4,222,445 | A | 9/1980 | Vadetsky et al. |
| 4,329,127 | A | 5/1982 | Tschirky et al. |
| 4,388,973 | A | 6/1983 | Winkelmann et al. |
| 4,683,964 | A | 8/1987 | Wenzel |

FOREIGN PATENT DOCUMENTS

| | | |
|---|---|---|
| GB | 2 073 285 | 10/1981 |
| RU | 2052065 | 1/1996 |
| RU | 2057882 | 4/1996 |
| RU | 2112855 | 6/1998 |
| SU | 114136 | 1/1958 |
| SU | 428074 | 5/1974 |
| SU | 620578 | 8/1978 |
| SU | 577823 | 3/1981 |
| SU | 977668 | 11/1982 |
| SU | 1093779 | 5/1984 |
| SU | 1104226 | 7/1984 |
| WO | WO-98/20228 | 5/1998 |

OTHER PUBLICATIONS

First Official Action w/Translation from the Russian Patent Office.
*Theory and Technique of Turbodrilling*, Ionesyn P.A., 1953, Moscow.

* cited by examiner

DRIVE SYSTEM

BACKGROUND OF INVENTION

The present invention relates to a drive system. In particular, but not exclusively, the present invention relates to a drilling assembly for a well; a bearing mechanism for a drilling assembly adapted to be located in a well; a sealing assembly for a generally hollow body and a method of sealing therefor; a drilling assembly for a well including a substantially shock eliminating coupling assembly; a substantially shock eliminating coupling assembly for a drilling assembly; and an assembly for location in a hollow body and for transferring a rotational drive force therethrough.

Drilling assemblies such as those used in the drilling of a borehole of an oil or gas well often include drilling motors which form part of a drill string used to drill the borehole. The drilling motor is coupled to a drill bit provided lowermost on the drill string, and which is coupled to the drill bit by a rotatable drive shaft. Typical conventional drilling motors include Positive Displacement Motors (PDMs) and turbines, both of which are fluid driven by a drilling fluid pumped down the drill string from the surface and through the drilling motor. The drilling fluid exits the drill string through ports in the drill bit, to carry drill cuttings from the drill bit and through the borehole to surface. PDMs typically operate at a slow rotational velocity with a high torque output, whilst turbines typically operate at high rotational velocities with a low output torque.

It is normally desired to carry out drilling operations in a low speed, high torque operation, reducing the likelihood of the drill bit sticking and reducing the likelihood of damage in the event that the drill bit does become stuck. PDMs are therefore preferred for low speed, high torque operations, however, PDMs have limitations in that they include elastomeric components, including the PDM stator, and the high pressures and temperatures experienced downhole during a drilling operation often lead to permanent damage of the elastomeric components, which can cause failure of the PDM and require frequent replacement. It is therefore preferred to use turbines as drilling motors which do not usually include elastomeric components. However, as turbines are high speed, low output torque motors, it is required to provide a gear reduction mechanism to reduce the rotational velocity and increase the output torque of the turbine. An alternative to the use of PDMs and turbines is the provision of electric motor drive systems. However, such systems suffer from the disadvantages of requiring electrical power and control connections to surface, which connections are complex and expensive to run and operate and susceptible to damage.

The development of low speed, high torque turbine driven drilling assemblies such as turbodrills has been achieved by the utilisation of a gear reduction mechanism in the drilling assembly. Downhole drilling assemblies have a tubular body outer diameter size limitation determined by the size of the hole to be drilled. Accordingly, the gear reduction mechanisms are typically of the epicyclical type, these being well known and having been developed for downhole applications in particular in the drilling industry of the former Soviet Union, as well as by companies in Canada, Great Britain, Germany and others.

Typically, such drilling assemblies comprise a turbine section consisting of a plurality of turbine power stages including rotors and stators, commonly mounted on a rotating drive shaft and contained within a tubular body. The turbine is connected to a drill bit drive shaft via a gear reduction mechanism including axial bearings, the axial bearings being required to absorb axial hydraulic thrust and mechanical loads. The gear mechanism is normally sealed to retain system lubrication oil and to attempt to prevent the ingress of drilling fluids into the gear mechanism. Typically, the sealed gear mechanism will contain the axial thrust bearings arranged as either a "balanced arrangement", where drill bit loads act against hydraulic loads (due to the pressure of the drilling fluid), or "non-balanced arrangements", where the axial thrust bearings for the hydraulic and mechanical loads are separated.

Such arrangements present various problems, including that turbine axial loading and vibration, hydraulic and mechanical bearing loadings, vibration and shock are transmitted directly into the gear reduction mechanism; additional heat and vibration is generated within the gear reduction mechanism; and failure of the sealed gear reduction mechanism (due, for example, to abrasive drilling fluid entering the system) results in axial bearing failure, causing extensive and costly damage to the gear reduction mechanism, the turbine and further damage to the bearings.

Such typical known drilling assemblies are disclosed in U.S. Pat. No. 3,365,170 (Whittle), U.S. Pat. No. 4,222,445 (Vadetsky et al), U.S. Pat. No. 4,329,127 (Tschirky et al), U.S. Pat. No. 4,683,964 (Wenzel), United Kingdom Patent Publication No. 2073285 (Zahnradfabrik), Canadian Patent No. 1257865 (Dreco) and International Patent Application No. PCT/EP97/06060 (Tiebo Tiefbohrservice GmbH & Co. KG).

U.S. Pat. No. 3,365,170 discloses a turbo-drill with inner and outer contra-rotating turbines. Speed reduction gearing is provided in the turbo-drill as part of the same assembly as a turbine and a bearing assembly for absorbing axial and radial loads exerted on the turbo-drill. A complex arrangement is provided for oil lubrication of the gearing and bearings which includes a pump for supplying oil under pressure to an oil chamber. Thus the bearings are contained within the gear reduction mechanism, the axial bearings in particular having a direct link to the gear mechanism. The lubrication oil provided for the bearings and gear mechanism is at substantially the same pressure as the drilling fluid which powers the turbine and is provided from a common supply. Disadvantages associated with the assembly of U.S. Pat. No. 3,365,170 include that the assembly requires an axial bearing mechanism in the immediate vicinity to the gear reduction mechanism. This may lead to failure as discussed above.

U.S. Pat. No. 4,222,445 discloses a reduction unit for a drilling motor. The casing of the assembly carries a reduction gear in a sealed chamber, with input and output shafts and with roller bearings provided for the shafts. The bearings and reduction gear are disposed in the sealed chamber which contains lubricating oil, and dividing spaces are provided containing a "buffer" fluid to protect the seals from drilling fluid. The input and output shafts carry axial loads directly to the reduction gearing, and the bearings, together with additional separate spherical bearings, are provided in the same unit as the reduction gear. This may lead to failure as discussed above. Furthermore, in the event of leakage of oil from the oil filled chamber, where the internal pressure is maintained substantially constant, drilling mud ingress is accepted, following depletion of the buffer fluid, which initially replaces lost lubrication oil.

U.S. Pat. No. 4,329,127 discloses a bearing assembly for use with a downhole fluid driven motor, and is directed to providing sealing means isolated from drilling fluid. Various radial and thrust bearings are provided in a housing, as well as shock absorbing and bearing loading spring means. The assembly includes a seal which is a complex mechanism including inner and outer reservoirs, one of which carries a material such as grease whilst the other carries a lubricating material such as oil, for lubricating the bearings and other components of the assembly. It is specifically desired that there is substantially no differential pressure across the two reservoirs. Furthermore, it is accepted that there may be drilling mud contamination into the outer grease carrying chamber and it is further accepted that particulate material from the drilling fluid will eventually penetrate through the seal to the bearings and gearing. This may lead to failure of the bearings due to wear by abrasive drilling fluid.

U.S. Pat. No. 4,683,964 discloses an improved downhole drill bit drive apparatus, and particularly relates to an improved sealing arrangement for the bearing assembly of the drive apparatus. A bearing chamber is defined by a casing of the apparatus, a drill string and by first and second seal means. The bearing chamber houses bearings and a speed reducing mechanism in a common lubricating fluid. The pressure of the lubricating fluid and external drilling fluid in a drill fluid passage are maintained substantially equal by the provision of a moveable annular piston, which is axially moveable in response to a pressure differential between the drilling fluid in the flow passage and the lubricating fluid in the bearing chamber, to equalise the pressure therebetween. This allegedly reduces the likelihood of leakage of drilling fluid into the bearing chamber. The assembly of U.S. Pat. No. 4,683,964 therefore suffers from disadvantages of the provision of the bearings together with the gear mechanism, which may lead to failure, as well as the potential for the ingress of drilling fluid causing wear.

GB 2073285 discloses a direct drive system for rotary drill bits. The system includes a drive portion, gear portion and bearing portion in a common, linked system which is not capable of being changed out on a rig floor. The system is instead assembled in a workshop as a one piece tool. The system includes an oil reservoir to provide lubricating oil to bearings and gears of the bearing and gear portions and for load compensation devices which provide a damping action in use. The bearings prevent the transmission of axial thrust forces from the turbine to the gear portion, however, there is a direct, rigid connection between the gear portion and the bearing portion. This may lead to failure as discussed above. A piston is provided which is loaded by a compression spring to exert a pressure force on the oil reservoir. However, a chamber in which the compression spring is disposed is open to drilling mud passing through the borehole returning to the surface, creating an area of hydrostatic pressure difference within a body of the system.

CA1257865 discloses improvements in the sealing arrangements for a bearing or combined bearing/gear reduction assembly. A drilling fluid is pumped down through a motor (a turbine or PDM) and flows through a chamber into a central bore of a drilling string to bypass a bearing/gear reduction chamber. An upper dynamic mechanical seal assembly is provided at the top of the chamber in a floating piston, exposed at an upper end to drilling mud. A lower dynamic mechanical seal assembly is provided at the bottom of the chamber, and together they define a lubricating fluid chamber in which bearing assemblies and a gear reduction assembly is located. Fluid in the lubricating chamber is provided at a higher pressure than the drilling mud to cause flow of lubricating fluid from the chamber, to prevent ingress of drilling fluid. This is not achieved by positively applying an over pressure on the lubricating fluid, but is dependent on fluid pressures outside the chamber. There is therefore a decreasing differential pressure as the lubrication chamber empties in service. In an alternative embodiment, a compression spring exerts a force on the floating piston to overpressure fluid in the lubricating chamber relative to the drilling fluid. The system of CA1257865 suffers from disadvantages including that the bearings are provided together with the gear mechanism, which may lead to failure, as discussed above.

PCT/EP97/06060 discloses drilling equipment, especially turbo-drills incorporating a reduction gear. The equipment comprises a turbine, a reduction gear and a spindle, the turbine including a seal and a radial thrust support. The reduction gear has input and output shafts connected through a gear, and the spindle has a body carrying a rotating shaft, a radial thrust support and a further seal. A chamber is defined by the seals and bushings of the equipment and contains lubricating oil. The equipment of PCT/EP97/06060 suffers from disadvantages including that the bearings are provided together with the gear mechanism, which may lead to failure as discussed above, and that the drilling fluid is likely to enter the sealed assembly over time.

It is an object of at least one embodiment of the present invention to obviate or mitigate at least one of the foregoing disadvantages.

SUMMARY OF INVENTION

According to a first aspect of the present invention, there is provided a drilling assembly for a well, the drilling assembly comprising:

a drill bit;

a rotational drive unit for generating a rotational drive force;

a gear mechanism coupled to the drive unit and to the drill bit, for transferring the rotational drive force through the gear mechanism to the drill bit; and a bearing mechanism for absorbing loads imparted on the drilling assembly during a drilling operation, the bearing mechanism being provided separately from the gear mechanism, to substantially isolate the gear mechanism from the bearing mechanism.

According to a second aspect of the present invention, there is provided a bearing mechanism for a drilling assembly adapted to be located in a well, the drilling assembly having a drill bit; a rotational drive unit for generating a rotational drive force; and a gear mechanism coupled to the drive unit and to the drill bit, for transferring the rotational drive force through the gear mechanism to the drill bit; wherein the bearing mechanism serves for absorbing loads imparted on the drilling assembly during a drilling operation, and wherein the bearing mechanism is provided separately from the gear mechanism, to substantially isolate the gear mechanism from the bearing mechanism.

Advantageously, the provision of the bearing mechanism separately from the gear mechanism avoids the gear mechanism becoming damaged, due to in particular, heat and vibration transmitted from the bearing mechanism to the gear mechanism in use. Such heat and vibration loads exerted upon the gear mechanisms of typical, known prior art drilling assemblies can lead to failure of the gear mechanism, ultimately causing failure of the bearing mechanism and rotational drive unit, which can be extensive and costly to repair, often requiring replacement of damaged components. Further advantageously, the separation of the bearing mechanism from the gear mechanism in the present invention may provide a gear mechanism which is relatively compact and simple compared to known drilling assemblies and bearing mechanisms provided integrally with gear mechanisms, reducing cost and simplifying maintenance.

It will be understood that references to the bearing mechanism being provided separately from the gear mechanism are to the bearing mechanism being provided in a location such that the gear mechanism is substantially isolated from, in particular, the vibrational loads of the bearing mechanism during use, but also from heat generated by the bearing mechanism.

Yet further advantageously, the present invention may provide a separate rotational drive unit, gear mechanism and bearing mechanism, which may facilitate quick and easy replacement or maintenance of one or more of said components. A drilling assembly may therefore be provided which is fully rig interchangeable on a rig floor in that it can be readily "broken out". Thus a drilling assembly may be provided where any of the drilling assembly tool assemblies, and in particular the gear or bearing mechanisms, may be readily broken out, for maintenance, replacement or the like. This allows tool assembly maintenance or replacement to be carried out on the drilling floor of an oil or gas rig with the minimum of rig downtime and without requiring the drilling assembly to be removed from the drilling floor.

Preferably, the gear mechanism is isolated from the bearing mechanism by an axially floating coupling, such as an axially floating shaft. A substantially shock eliminating coupling assembly may be provided for coupling the gear mechanism to one or both of the drive unit and/or the drill bit, to allow isolation of the gear mechanism from the bearing mechanism.

Preferably, the rotational drive unit comprises a turbine, and the gear mechanism serves for reducing the rotational velocity and increasing the torque of the drill bit relative to the rotational drive unit. Advantageously, this may allow use in so-called relatively low speed, high torque operations.

The bearing mechanism may comprise a first bearing unit adapted to absorb hydraulic loads exerted upon one or more of the rotational drive unit and gear mechanism by a fluid passing through the drilling assembly to the drill bit; and a second bearing unit adapted to absorb mechanical loads exerted upon one or more of the rotational drive unit and the gear mechanism transmitted from the drill bit. Alternatively, the bearing mechanism may comprise a single bearing unit adapted to absorb both hydraulic loads due to fluid passing through the drilling assembly to the drill bit and mechanical loads transmitted from the drill bit. Preferably, the bearing mechanism is provided integrally with the rotational drive unit. Alternatively, the bearing mechanism may be provided as a separate unit of the drilling assembly, and may be coupled to the top or bottom of the rotational drive unit. The gear mechanism may be provided between the rotational drive unit and the drill bit, the drill bit being lowermost in the drilling assembly. Advantageously, this may place the bearing mechanism at a distance from the gear mechanism to space the gear mechanism from heat and vibration generated by the bearing mechanism in use. Conveniently, the first bearing unit is provided at the top of the rotational drive unit. The first bearing unit may comprise a plurality of thrust bearings. The second bearing unit may be provided between the drill bit and the gear mechanism, to absorb the mechanical loads transmitted from the drill bit and to prevent transmission of said mechanical loads to the gear mechanism. The first and/or second bearing units may comprise a plurality of sliding element or mud lubricated rolling element type bearings.

Preferably, the bearing mechanism is sealed from the ingress of fluid, particularly drilling mud, from the drilling assembly. Preferably also, the bearing mechanism is lubricated by a lubricating fluid, which lubricating fluid is pressurised to a pressure greater than the ambient pressure of fluid within the drilling assembly. Advantageously, this may create a positive leakage of lubrication fluid from the bearing mechanism in use, said positive lubricating fluid leakage preventing ingress of fluid from the drilling assembly. Prevention of ingress of fluid from the drilling assembly, such as drilling fluid, which contains abrasive particles, prevents excessive wear of the bearing mechanism by the drilling fluid. Preferably also, the gear mechanism is sealed from ingress of fluid from the drilling assembly, and may be lubricated by a lubricating fluid pressurised to a pressure greater than the ambient pressure of fluid within the drilling assembly: The fluid in the drilling assembly may be a drilling fluid such as a drilling mud, air or Nitrogen foam, said drilling fluid driving the rotational drive unit to create the rotational drive force.

According to a third aspect of the present invention, there is provided a sealing assembly including a generally hollow body, the body defining a flow path therethrough for a first fluid and a chamber, separate from said first fluid flow path, a second fluid being provided in the chamber at a pressure greater than ambient pressure of the first fluid, to seek to prevent ingress of the first fluid into the chamber.

By this arrangement, the second fluid is "over-pressured" relative to the first fluid, such that any second fluid bleeding out of seals of the chamber sacrificially seeks to ensure that second fluid within the chamber is not contaminated.

Preferably, the sealing assembly is a sealing assembly for a downhole tool, and may be a sealing assembly for part of a drilling assembly. The sealing assembly may be a sealing assembly for a bearing mechanism, the bearing mechanism preferably being disposed within the generally hollow body of the sealing assembly. Preferably, the sealing assembly may be a sealing assembly for a gear mechanism, the gear mechanism preferably being disposed within the generally hollow body of the sealing assembly. Preferably, the sealing assembly for the gear mechanism includes a lip seal to prevent ingress of the first fluid into the gear mechanism. This is particularly advantageous in that it provides an improved seal over many other types of seal. Alternatively, the sealing assembly includes a mechanical seal or a combination of one or more mechanical/lip type seals. Advantageously, this may provide a sealing assembly where the first fluid is substantially prevented from entering the chamber, which may be particularly desired where, for example, the second fluid is a lubricating fluid for lubricating, for example, the bearing mechanism and/or the gear mechanism, and where entry of the first fluid into the chamber would contaminate the second fluid, leading to possible damage of the bearing mechanism and/or gear mechanism.

Where the sealing assembly is for a bearing mechanism, at least part of an elongate rotatable member may be located within the chamber journalled to bearings of the bearing mechanism. In this fashion, the second fluid, which may be a lubricating fluid, may lubricate the bearings of the bearing mechanism, which bearings are adapted to support one or more of axial and radial loading imparted thereon by the elongate rotatable member. Preferably, the bearing mechanism is coupled to a rotational drive unit by the elongate rotatable member. The rotational drive unit may comprise a turbine and the elongate rotatable member may be a turbine power shaft. In this fashion, it will be understood that where the turbine is a fluid driven turbine driven by, for example, abrasive drilling mud, entry of such drilling mud into the chamber housing the bearing mechanism would quickly lead to failure of the bearing mechanism due to abrasive wear. It will be understood that the present invention is particularly advantageous in preventing the ingress of such abrasive drilling fluids.

It will further be understood that it is equally desired to prevent the ingress of such abrasive drilling fluids where the sealing assembly is a sealing assembly for a gear mechanism, as such abrasive fluids would also quickly lead to failure of the gear mechanism.

It has been found by the applicants that under the operating conditions experienced downhole, it is not possible to provide a "perfect" seal with sealing assemblies of a conventional type known in the art. It has therefore been found impossible with such prior art assemblies to prevent the eventual ingress of abrasive drilling fluids into lubricated mechanical components such as bearing and gear mechanisms. The present invention is particularly advantageous in that the provision of the second fluid in the chamber at a pressure greater that ambient pressure of the first fluid prevents ingress of the first fluid into the chamber by creating a positive displacement of the second fluid from the chamber, this displacement of the second fluid also serving to lubricate, for example, mechanical seals of the sealing assembly. Preferably, displacement of the second fluid from the chamber is dynamic in that displacement only occurs in use, when, for example, the elongate rotatable member coupled to the bearing mechanism is rotated. There is therefore, preferably, no static displacement of the second fluid from the chamber.

The generally hollow body of the sealing assembly may comprise an outer sleeve or housing, and the sealing assembly may further comprise an inner sleeve located within the outer sleeve, the flow path being defined between an inner surface of the outer sleeve and an outer surface of the inner sleeve. The inner sleeve may define the chamber. Where the sealing assembly comprises a sealing assembly for a bearing mechanism, the inner sleeve may comprise a bearing housing.

Preferably, the second fluid in the chamber is pressurised by a mechanical pressure assembly. The mechanical pressure assembly may comprise an axially moveable piston disposed in the generally hollow body in communication with the chamber, the piston being biassed to exert a pressure force upon the second fluid in the chamber. The piston is preferably biassed by a compression spring. An upper end of the compression spring may be coupled to the generally hollow body and a lower end of the spring may be coupled to the piston to exert the biassing force. The flow path may be defined over an outer surface of the piston, through the compression spring and into the flow path defined between the inner and outer sleeves. The piston may be sealed to the chamber by an annular lip seal. The piston may be mounted within the body by an annular mounting plate, the plate having axial flow ports therein for the passage of the first fluid.

The sealing assembly may further comprise a mechanical seal disposed lowermost in the chamber. Displacement of the second fluid from the chamber may be permitted through the lower mechanical seal. The mechanical seal may comprise two annular discs located in face to face disposition. One of said discs may be fixed relative to the generally hollow body, whilst the other one of said discs may be rotatable relative to the generally hollow body. Displacement of the second fluid from the chamber may lubricate adjacent, facing surfaces of the two discs in use. This may advantageously allow a controlled dynamic displacement of second fluid from the chamber. Where the sealing assembly comprises a sealing assembly for a bearing mechanism, the fixed one of said discs may be coupled to the generally hollow body, whilst the rotatable one of said discs may be coupled to the elongate rotatable member.

According to a fourth aspect of the present invention, there is provided an epicyclical gear unit including a sealing assembly in accordance with the third aspect of the present invention.

According to a fifth aspect of the present invention, there is provided a method of sealing an internal chamber of a generally hollow body from a first fluid flowing in a flow path defined by the generally hollow body, a second fluid being provided in the chamber, the method comprising the steps of:

pressurising the second fluid in the chamber to a pressure greater than ambient pressure of the first fluid to, in use, create a positive dynamic displacement of the second fluid from the chamber, thereby substantially preventing ingress of the first fluid into the chamber.

Conveniently, the internal chamber is substantially statically sealed.

It will be understood that references herein to the chamber being statically sealed are that, when out of use, there is no substantial displacement of the second fluid from the chamber, and references to a positive dynamic displacement are that, in use, when the first fluid is flowing through the flow path, there is a displacement of the second fluid from the chamber.

The method may comprise a method of sealing an internal chamber of a bearing mechanism, the bearing mechanism contained within the internal chamber. Alternatively, the method may comprise a method of sealing an internal chamber of a gear mechanism contained within the internal chamber. It will be understood that the second fluid may comprise a lubricating fluid for lubricating the bearing mechanism or gear mechanism. Preferably, the method further comprises the step of coupling the generally hollow body to a downhole tool for location in an oil or gas well. The first fluid may be a drilling fluid provided for driving a rotational drive unit coupled to a drill bit for drilling a borehole of a well or the like.

According to a sixth aspect of the present invention, there is provided a drilling assembly for a well, the drilling assembly comprising:

a drill bit;

a rotational drive unit for generating a rotational drive force;

a gear mechanism coupled to the drive unit and to the drill bit, for transferring the rotational drive force through the gear mechanism to the drill bit; and a substantially shock eliminating coupling assembly for coupling one of the drive unit to the gear mechanism and the gear mechanism to the drill bit, the coupling assembly serving for isolating the gear mechanism from mechanical loads exerted on the drilling assembly in use.

According to a seventh aspect of the present invention, there is provided a substantially shock eliminating coupling assembly for a drilling assembly, the drilling assembly having a drill bit, a rotational drive unit for generating a rotational drive force, and a gear mechanism coupled to the drive unit and to the drill bit, for transferring the rotational drive force through the gear mechanism to the drill bit, one of the drive unit and the drill bit being coupled to the gear mechanism by the coupling assembly, the coupling assembly serving for isolating the gear mechanism from mechanical loads exerted on the drilling assembly in use.

Advantageously, the substantially shock eliminating coupling assembly substantially eliminates axial "shock" loads exerted on the drilling assembly in use, that is, those experienced by the drilling assembly above and beyond the normal loads experienced in, for example, drilling of a borehole. The capacity of the coupling assembly to absorb such shock loads protects the gear mechanism, which is sensitive to such shock loads, from becoming damaged, which may otherwise quickly lead to failure of the gear mechanism and other tool assemblies or components of the drilling assembly. It will be understood that reference herein to loads exerted on the drilling assembly may be either mechanical loads exerted on the drilling assembly from the drill bit when it contacts a rock formation or the like to be drilled, as well as loads experienced in the drilling assembly due to the hydraulic loading of pressurised drilling fluid or the like passing through the drilling assembly to the drill bit. It will be understood that such hydraulic loads are due to the pressure of the drilling fluids, and that direct mechanical loads are exerted on the drilling assembly as the drilling fluid passes therethrough.

Preferably the drilling assembly further comprises a bearing mechanism for absorbing loads experienced by the drilling assembly during normal use. The bearing mechanism may comprise a bearing mechanism as defined in the first to fourth aspects of the invention defined above.

Conveniently, the gear mechanism is for reducing the rotational velocity and increasing the torque of the drill bit relative to the rotational drive unit. The rotational drive unit is preferably a turbine driven by drilling fluid passing through the drilling assembly. Conveniently, the gear mechanism is disposed between the rotational drive unit and the drill bit.

Preferably two coupling assemblies are provided, one for coupling the drive unit to the gear mechanism and one for coupling the gear mechanism to the drill bit. In this fashion, the gear mechanism may be isolated both from mechanical loads exerted on the drilling assembly by the drill bit, and by loads exerted on the drilling assembly by the drilling fluid, that is, hydraulic loads. Preferably, the or each coupling assembly comprises a floating axial coupling for transferring rotational force and isolating axial shock loads. The coupling assembly may comprise a splined connection between tubular members of the one of the drill bit and the drive unit and the gear mechanism. Where two coupling assemblies are provided, the coupling assembly may comprise splines formed on one of a shaft of the gear mechanism and shafts of the drill bit and the drive unit. Preferably, one of the gear mechanism shaft and the tubular members of the drill bit and the drive unit carries a shoulder for restraining axial movement between said tubular member and the gear mechanism shaft, wherein an axial spacing is provided between said shoulders and the ends of the gear mechanism shaft, to allow for axial movement therebetween in the event of a shock loading being experienced by one or both of the drill bit and the drive unit. It will be understood that the use of such splined connections allows the transferral of a rotational drive force, but prevents the transmission of axial shock loads, due to the provision of the spacing.

According to an eighth aspect of the present invention, there is provided a gear mechanism for a drilling assembly adapted to be located in a well, the drilling assembly including a drill bit and a rotational drive unit, the gear mechanism being coupled to the drill bit by a torsionally flexible shaft.

Preferably, the gear mechanism is coupled also to the rotational drive unit by a torsionally flexible shaft.

The torsionally flexible shafts may be of ferrous or non-ferrous alloy steels, Beryllium Copper or Titanium alloys.

Advantageously, the provision of a gear mechanism including such torsionally flexible shafts reduces the transmission of rotational or torsional shock loads to the gear mechanism, reducing the likelihood of damage thereto. Such shock loads may be experienced when the drilling assembly is used, for example, to drill a borehole of a well where the drill bit is coming into contact with a rock formation or the like to be drilled.

According to a ninth aspect of the present invention, there is provided a turbine power unit for a drilling assembly adapted to be located in a well, the turbine power unit including a turbine for generating a rotational drive force for the drilling assembly; and a bearing mechanism for absorbing loads imparted on the drilling assembly during a drilling operation, the bearing mechanism being provided separately from a gear mechanism of the drilling assembly, to substantially isolate the gear mechanism from the bearing mechanism.

Advantageously, provision of a turbine power unit including a turbine and bearing mechanism allows isolation of the gear mechanism from the bearing mechanism, and provides a compact arrangement which is easily broken out for maintenance/tool assembly replacement on a rig floor.

According to a tenth aspect of the present invention, there is provided an assembly for location in a hollow body and for transferring a rotational drive force therethrough, the assembly comprising:

a rotational drive unit through which the rotational drive force is transferred;

a gear mechanism coupled to the drive unit and to a rotatable member, for transferring the rotational drive force between the rotational drive unit and the rotatable member; and a bearing mechanism for absorbing loads imparted on the assembly through the rotatable member, the bearing mechanism being provided separately from the gear mechanism, to isolate the gear mechanism from the bearing mechanism.

Advantageously, this may provide an assembly including a bearing mechanism which is isolated from a gear mechanism, such that the gear mechanism is isolated from, for example, transmission of heat and vibration generated by the bearing mechanism in use. Preferably, the assembly is a drilling assembly adapted to be located in a well, where the rotatable member is coupled to a drill bit. The rotational drive unit may comprise a turbine, Positive Displacement Motor (PDM) or any other unit suitable for generating a rotational drive force. Alternatively, the rotational drive unit may comprise a pump and the rotatable member may comprise a motor or a shaft coupled to the motor.

The assembly may comprise a gear mechanism, a bearing mechanism and/or a drilling assembly as defined in the above aspects of the present invention.

According to a further aspect of the present invention, there is provided a gear mechanism for a drilling assembly, the gear mechanism provided separately from a bearing mechanism of the drilling assembly, to substantially isolate the gear mechanism from the bearing mechanism.

According to a still further aspect of the present invention, there is provided a bearing assembly comprising a generally hollow body defining a sealed chamber in which one or more bearings are located, and a flow path for a fluid, which flow path extends around said sealed chamber.

This is particularly advantageous as the fluid flowing through the fluid flow path cools lubricating fluid in the chamber, which is heated by the bearings in use. Also, direction of the first fluid around the chamber allows a reduced number of seals to be provided and allows the pressure differential across the seals to be minimised.

Preferably, the flow path is for a first fluid and a second, lubricating fluid is providing in the chamber, which may be at a pressure greater than ambient pressure of the first fluid.

BRIEF DESCRIPTION OF DRAWINGS

Embodiments of the present invention will now be described, by way of example only, with reference to the accompanying drawings, in which.

DETAILED DESCRIPTION OF EMBODIMENT

Figure 1:
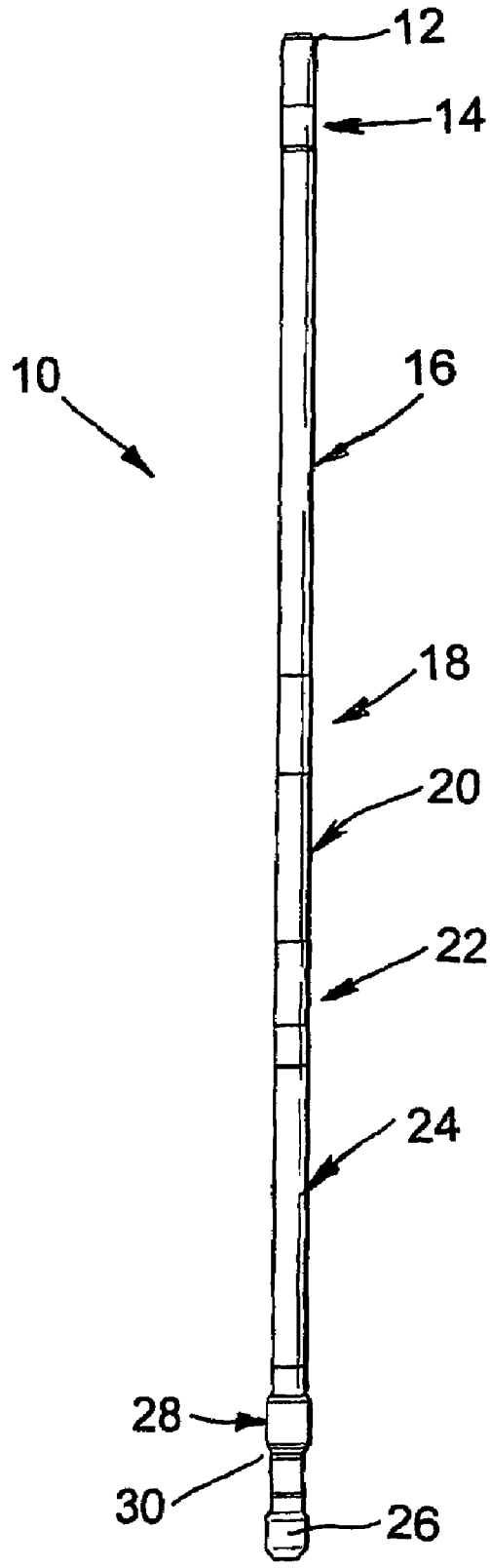
FIG. 1 is schematic view of a drilling assembly in accordance with an embodiment of the present invention.

Referring firstly to FIG. 1, there is shown a schematic view of a drilling assembly in accordance with an embodiment of the present invention, and indicated generally by reference numeral 10. The drilling assembly is of the type used for drilling a borehole of an on or offshore oil or gas well, or for carrying out reaming or milling operations downhole. The drilling assembly 10 comprises an, upper end 12 for coupling the drilling assembly 10 to a drill string (not shown) used for running the drilling assembly downhole and includes a number of tool assemblies. These include a bearing mechanism comprising a first, upper bearing unit 14 provided integrally with a rotational drive unit in the form of a fluid driven turbine 16; a first substantially shock eliminating coupling assembly 18 for coupling the turbine 16 to a gear mechanism 20; a second substantially shock eliminating coupling assembly 22, for coupling the gear mechanism 20 to a second, lower bearing unit 24, forming part of the bearing mechanism; and a drill bit 26 provided lowermost on the drilling assembly 10. A stabiliser/centraliser 28 is provided above the drill bit 26, for stabilising the drilling assembly 10 and centralising it within a borehole.

Figure 2A:
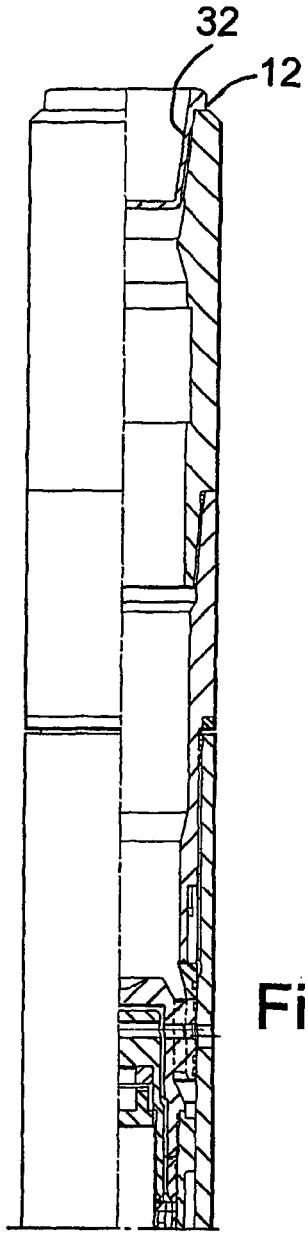
FIGS. 2A to 2H are enlarged, detailed, longitudinal half-sectional views of the drilling assembly of FIG. 1, progressively from an upper end of the assembly shown in FIG. 2A, to a lower end of the assembly shown in FIG. 2H.
Figure 2B:
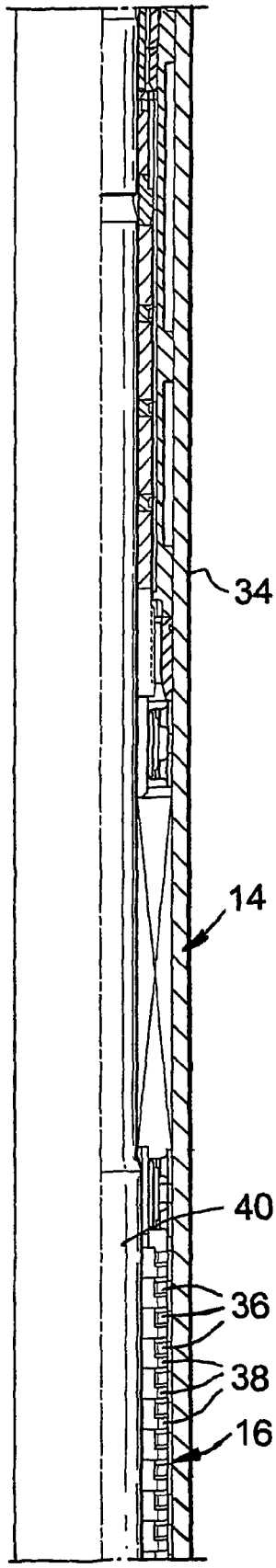
Figure 2C:
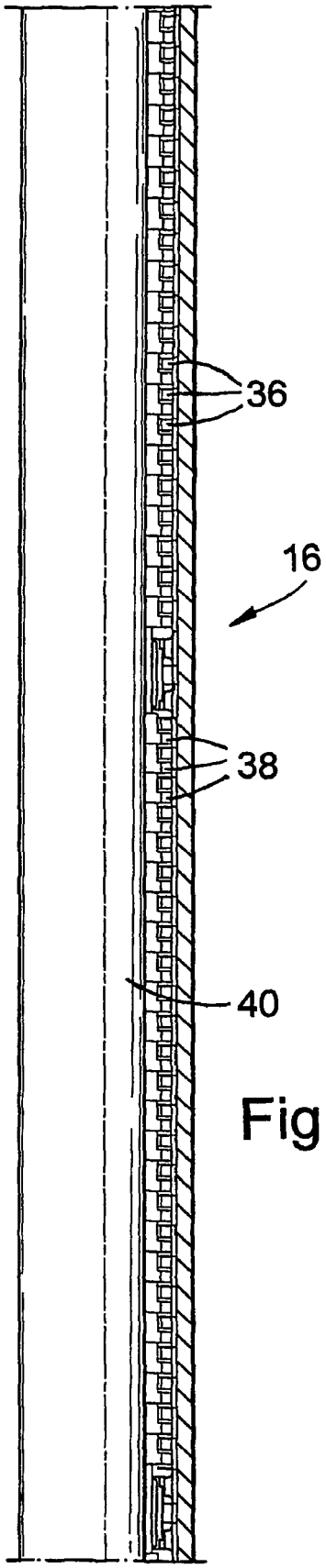
Figure 2D:
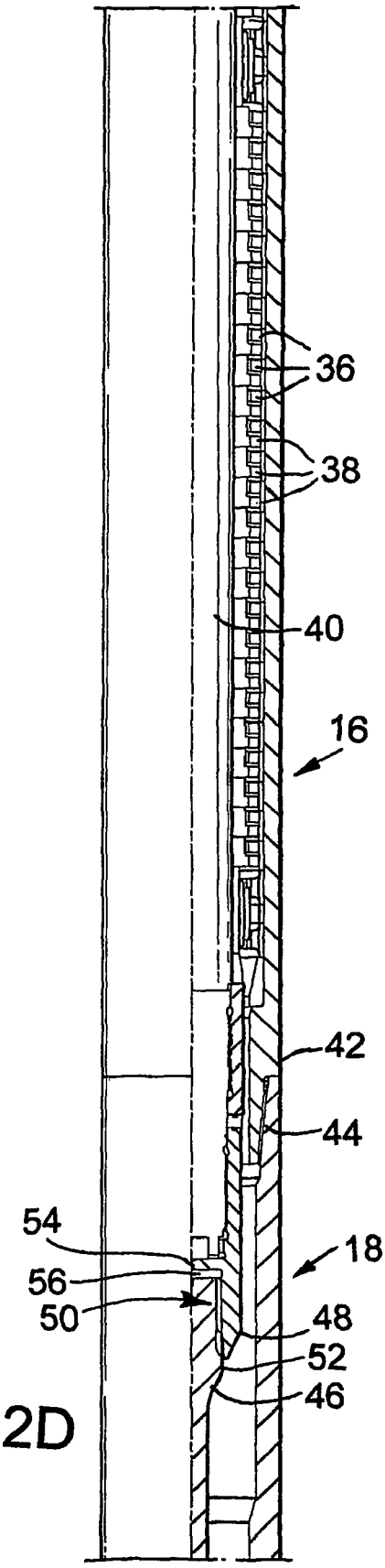
Figure 2E:
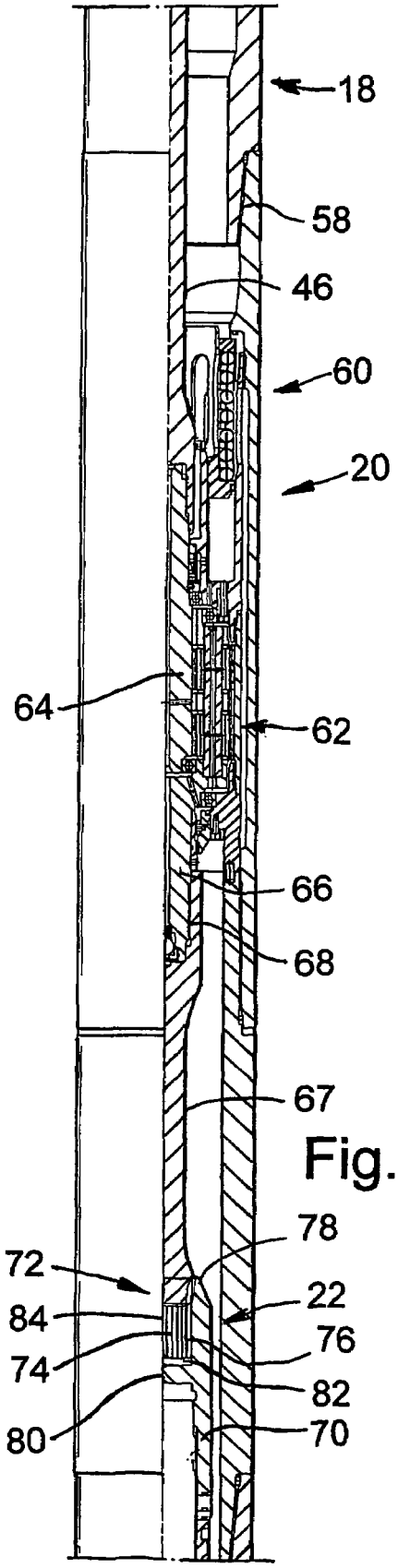
Figure 2F:
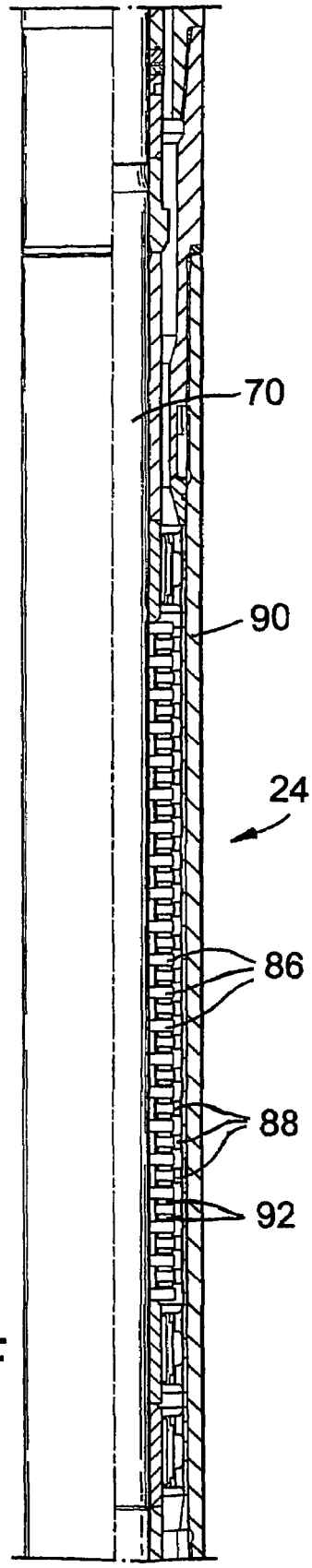
Figure 2G:
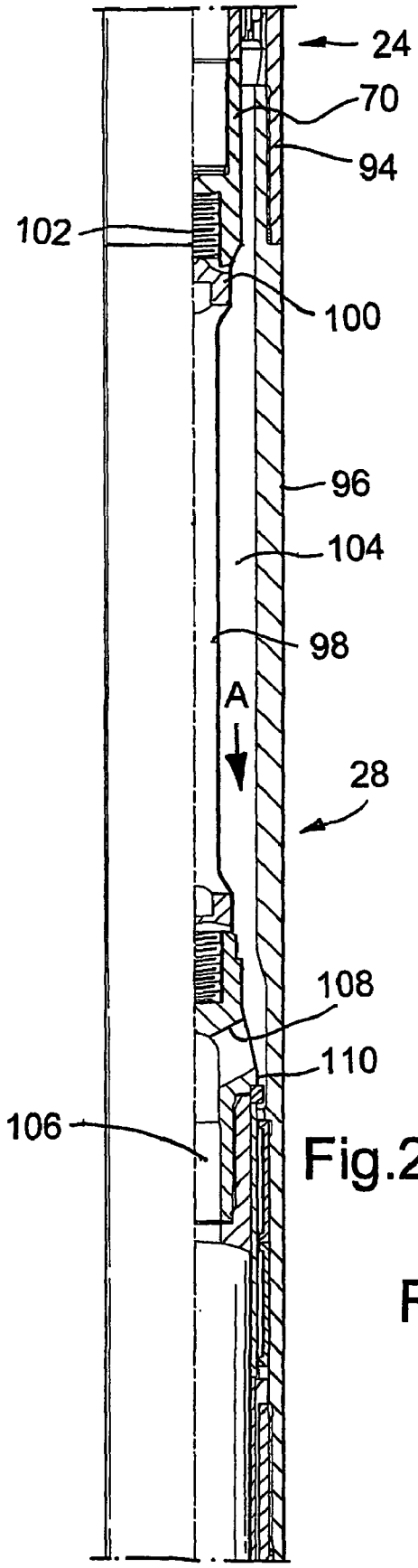
Figure 2H:
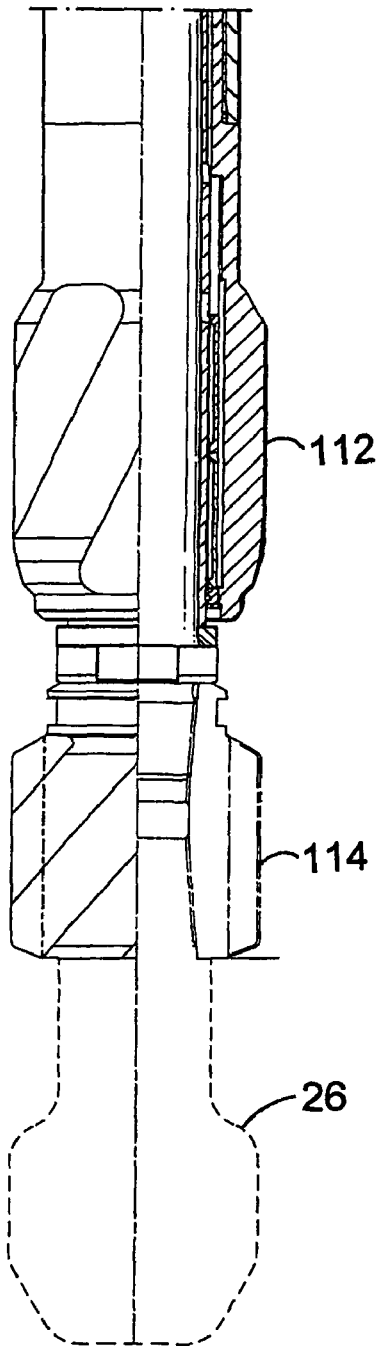

Referring now to FIGS. 2A to 2H, there are shown enlarged, detailed, longitudinal half-sectional views of the drilling assembly 10 of FIG. 1, progressively from the upper end 12 shown in FIG. 2A, to the lower end 30 carrying the drill bit 26, shown in FIG. 2H. The upper end 12 of the assembly 10 has a tapered opening 32 carrying American Petroleum Industry (API) tapered threads for coupling to drill pipe of a drill string (not shown) by conventional pin and box connections, in a fashion known in the art. Such pin and box connections are used for coupling the various tool assemblies of the drilling assembly 10 together.

As shown in FIG. 2B, the first, upper bearing unit 14 is provided in an extension of a tubular housing 34 of the turbine 16, as will be described in more detail with reference to FIG. 3A below. The housing 34 is coupled to an outer sleeve of the upper bearing unit 14, and the bearing unit 14 is provided above the turbine 16. The turbine 16 is fluid driven by drilling fluids pumped down the drill string and through the drilling assembly 10, both to drive the turbine 16, and to jet drill cuttings away from the drill bit 26. To achieve this, the drilling fluid exits the drill bit 26 through discharge apertures (not shown), in a fashion known in the art, before returning to the surface in the annulus defined between the borehole and the drilling assembly 10 and drill string, to carry the drill cuttings to surface.

The drilling fluid pumped down through the drilling assembly 10 creates a hydraulic thrust loading on the drilling assembly 10 and in particular upon the turbine 16. The upper bearing unit 14 is provided to absorb the loads imparted upon the drilling assembly 10 and the turbine 16 in particular, to prevent damage to the tool assemblies or components of the drilling assembly.

The turbine 16 is of the type well known in the art, and comprises a series of stator blades 36 fixed to the tubular housing 34 of the turbine 16, and a series of alternately positioned rotor blades 38, fixed to a drive shaft 40 of the turbine 16. As will be understood by persons skilled in the art, drilling fluid flowing down through the drilling assembly 10 flows between the stator and rotor blades 36, 38, causing the rotor blades 38 to rotate between the stator blades 36, rotating the drive shaft 40 of the turbine 60 to generate a rotational drive force for the drill bit 26.

At a lower end 42 of the turbine 16., the turbine 16 is connected through the first substantially shock eliminating coupling assembly 18 (by a pin and box connection 44) to the gear mechanism 20, as shown particularly in FIGS. 2D and 2E. Each of the coupling assemblies 18 and 22 define "floating" couplings, as will be described below. The coupling assembly 18 transfers the rotational drive force of the turbine drive shaft 40 to the gear mechanism 20, and includes a torsionally flexible gear mechanism input shaft 46 which engages the drive shaft 40 of the turbine 16. The lower end 48 of the turbine drive shaft 40 engages the input shaft 46 of the gear mechanism 20 by a splined connection 50. This splined connection 50 comprises a plurality of axially extending splines formed on an interior surface of the lower end 48 of the hollow drive shaft 40 which mate with corresponding splines formed on an outer surface of an upper end 52 of the gear mechanism input shaft 46.

It will be understood that the splined connection 50 allows the transmission of rotational drive force from the turbine drive shaft 40, but prevents the transmission of axial shock loads through the turbine 16 to the gear mechanism 20, such as those which may be experienced when an excessive drilling fluid "weight" (high fluid pressure) is experienced by the drilling assembly 10 and not absorbed by the first upper bearing unit 14. Such shock loads are absorbed by relative free axial movement between the splines on the drive shaft 40 and the gear mechanism input shaft 46 which together form the splined connection 50. To allow for such axial movement, to prevent transmission of these axial shock loads, the turbine drive shaft 40 includes a radially inwardly extending shoulder 54, which defines a generally cylindrical axial gap 56 between the shoulder 54 and the top surface of the upper end 52 of gear mechanism input shaft 46. This cylindrical axial gap 56 is dimensioned to allow sufficient free axial movement between the turbine drive shaft 40 and the gear mechanism input shaft 46 to prevent transmission of the axial shock loads.

FIG. 2E in particular shows the connection between the first coupling assembly 18 and the gear mechanism 20, which is achieved by a pin and box connection 58. The gear mechanism 20 is an epicyclical mechanism similar to typical, known gear mechanisms and will be discussed in more detail with reference to FIGS. 4B to 4D below.

However, generally speaking the gear mechanism 20 includes a sealing assembly 60 for preventing the ingress of drilling fluids passing through the drilling assembly 10. The sealing assembly 60 will also be described in more detail with reference to FIG. 4B below. The gear mechanism 20 generally includes gearing 62, coupled to the turbine drive shaft 40 through the gear mechanism input shaft 46. A main sun gear shaft 64 is provided coupled through a planetary gear carrier 66, by a threaded connection 68, to a torsionally flexible output shaft 67. The torsionally flexible gear input and output shafts 46 and 67 are typically of ferrous or non-ferrous alloy steels, Beryllium Copper or Titanium alloys, and are torsionally flexible to absorb radial shock loading transmitted to the gear mechanism 20 during a drilling operation. Such radial shock loads may be experienced in particular when the drill bit 26 is cutting a rock formation. This is particularly advantageous in reducing the radial shock loading transmitted to the gear mechanism 20, thereby reducing the likelihood of shock damage on the gear mechanism due to such radial shock loads.

The gear mechanism 20 is a reduction gear mechanism which rotates the drill bit 26 at a lower rotational velocity and higher torque than the turbine 16. This is generally desired in drilling and milling operations, which are better suited to operations where the drill bit 26 is rotated at low speed and high torque, to prevent damage to the drilling assembly 10 in the event that the drill bit 26 becomes stuck during a drilling operation. It will be understood that the gearing 62 reduces the rotational velocity of the gear mechanism output shaft 64 relative to the sun gear shaft 46, connected to the turbine drive shaft 40, and thereby increases the torque supplied.

The second substantially shock eliminating coupling assembly 22 is provided integrally with the gear mechanism 20, and is substantially identical to the first coupling assembly 18 described above. In detail, the gear mechanism output shaft 64 is coupled to a first part 70 of a drill bit drive shaft by a splined connection 72, shown in more detail than the splined connection 50 of the first shock absorbing coupling assembly 18 of FIG. 2D. It will be seen that the gear mechanism output shaft 67 carries external axially extending splines 74 which engage with corresponding internal axially extending splines 76 provided on an upper end 78 of the first part 70 of the drill bit drive shaft. A radially inwardly extending shoulder 80 is also provided, defining a substantially cylindrical axial gap 82 between a lower face of a lower end 84 of the gear mechanism output shaft 67 and the shoulder 80. This allows for relative free axial movement between the shafts 67 and 70, in a similar fashion to the coupling assembly 18.

As shown in FIG. 2F, the first part 70 of the drill bit drive shaft carries the second, lower bearing unit 24. The bearing unit 24 is therefore provided separately from the gear mechanism 20, in a separate outer sleeve 90, with the gear mechanism 20 sealed from the drilling fluid passing through the bearing unit 24. However, it will be understood that the gear mechanism 20 and bearing unit 24 may equally be provided in a single housing. The bearing unit 24 comprises sliding element type bearings of a type well known in the art, and including annular metallic thrust bearing elements 86, disposed between second annular bearing elements 88 coupled to the outer sleeve 90 of the bearing unit 24. The metallic bearing elements 36 are typically of a Chrome Oxide plated steel of a type known in the art. The second annular bearing elements 88 carry elastomeric bearing pads 92 and in use, the bearing elements 86 rotate between the pads 92 of adjacent second annular bearing elements 88. The bearing unit 24 absorbs axial mechanical loads exerted on the remainder of the drilling assembly 10 in a direction upwardly from the drill bit 26 in use. Thus normal mechanical loads experienced by the drill bit 26 in, for example, drilling a borehole, are absorbed by the bearing unit 24, to prevent damage to the gear mechanism 20 and turbine 16. It will be noted that in the embodiment shown, the second lower bearing unit 24 operates in the drilling fluid passing down through the drilling assembly 10 to the drill bit 26, and is not sealed and lubricated by a lubricating fluid such as oil, as is the first upper bearing unit 14, as will be described below.

As shown in FIG. 2G, the second lower bearing unit 24 is coupled to the stabiliser/centraliser 28 by a threaded connection 94, and an outer housing 96 of the stabiliser/centraliser 28 houses a second part 98 of the drill bit drive shaft, connected at an upper end 100 to the first part 70 of the drill bit drive shaft by a threaded connection 102. Drilling fluid having flowed down through the drilling assembly 10 passes through an annulus 104 defined between an inner surface of the housing 96 and an outer surface of the second part 98 of the drill bit drive shaft, in the direction of the arrow A. The drilling fluid then enters an interior chamber 106 of the drill bit drive shaft through a number of ports 108 (one only shown) formed in a lower end 110 of the second part 98 of the drill bit drive shaft. The drilling fluid then flows through the interior chamber 106 to the drill bit 26 (shown in broken outline in FIG. 2H), before exiting jetting nozzles (not shown) in the drill bit 26 for removing drill cuttings from the vicinity of the drill bit 26 in use. The housing 96 carries stabilising/centralising bodies 112 and 114 for stabilising and centralising the drilling assembly 10 in the borehole being drilled.

Figure 3A:
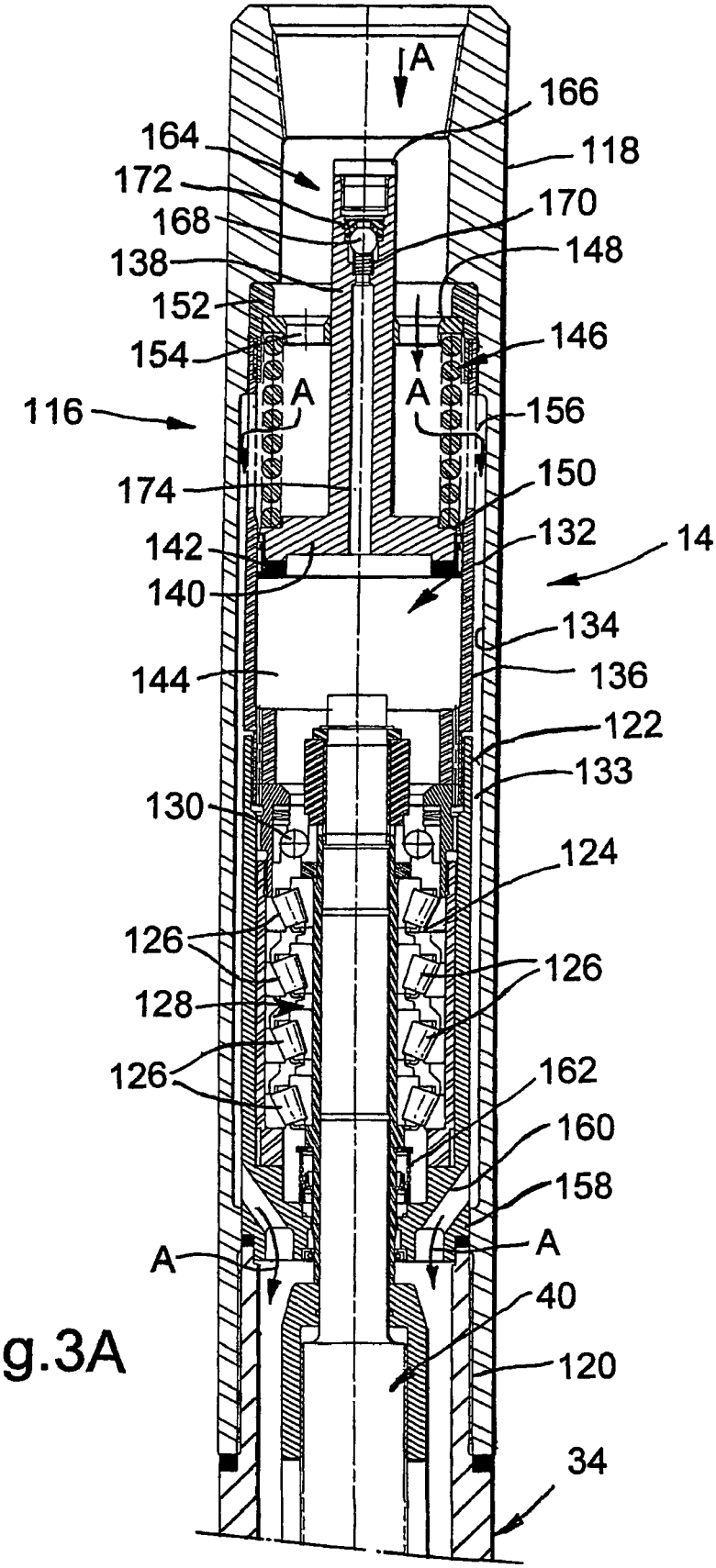
FIG. 3A is an enlarged longitudinal sectional view of a sealing assembly and a bearing mechanism incorporating the sealing assembly, forming part of the drilling assembly of FIGS. 1 to 2H.

Referring now to FIG. 3A, there is shown an enlarged longitudinal sectional view of a sealing assembly indicated generally by reference numeral 116, provided as part of the first upper bearing unit 14 of the bearing mechanism forming part of the drilling assembly 10 of FIGS. 1 to 2H. The bearing unit 14 includes a generally hollow body in the form of an outer sleeve 118 coupled to the tubular housing 34 of the turbine 16 via a threaded connection 120. The bearing unit includes an inner sleeve or bearing system housing 122 which houses a bearing pack indicated generally by reference numeral 124. The bearing pack 124 includes a number of tapered roller bearings 126 which are journalled to an upper end 128 of the turbine drive shaft 40, and which are designed to support primarily axial loading exerted upon the turbine 16, due to the hydraulic loading of the drilling fluid passing through the drilling assembly 10 in the direction of the arrow A. The tapered roller bearings 126 are able to support some radial loading in addition to the axial loading, however, a radial, spherical roller bearing 130 is provided above the tapered roller bearings 126, to provide the main support for radial loading upon the turbine 16. The spherical roller bearings 130 are not able to support any axial loading, this being borne by the tapered roller bearings 126.

The bearing pack 124 and the upper end 128 of the turbine drive shaft 40 are provided in a sealed chamber 132 which is filled with a lubricating fluid, typically oil. An annular flow path 133 is defined between an inner surface 134 of the outer sleeve 118 and an outer surface 136 of the inner sleeve 122, for the flow of drilling fluid through the drilling assembly 10 to the drill bit 26. The drilling fluid, typically a drilling mud containing abrasive particles, is therefore bypassed around the bearing pack 124 in the sealed chamber 132. The sealing assembly 116 is provided to prevent ingress of the pressurised drilling fluid into the oil filled chamber 132, where it would cause substantial damage to the bearing pack 124.

This sealing assembly 116 includes a piston 138 which is axially moveable within the sleeves 118 and 112 of the bearing unit 14, and comprises a piston head 140 which engages the inner sleeve 122 and includes an elastomeric lip seal 142, for sealing the piston to the inner sleeve 122. In this position, the piston head 140 acts upon an oil reservoir 144 of the sealed chamber 132 which supplies oil to the bearing pack 124. The piston 138 is biassed towards the bearing pack 124, to pressurise oil in the oil reservoir 144, by a compression spring 146, which exerts a biassing force upon the piston head 140. The compression spring 146 is provided between an annular mounting plate 148 which mounts and centralises the piston 138 in the sleeves 118, 122 and a groove 150 on the piston head 140.

The mounting plate 148 abuts a shoulder 152 of the inner sleeve 122, and includes flow ports 154 through which drilling fluid may flow, as indicated by the arrows A. Apertures 156 are provided around a wall of the inner sleeve 122 in the vicinity of the compression spring 146, and the drilling fluid flows through gaps between the spring coils and the apertures 156 and into the annular flow path 133, bypassing the bearing pack 124. A lower end 158 of the inner sleeve 122 includes flow ports 160 through which the drilling fluid may exit the annular flow path 133, as shown again by the arrows A.

In use, when the drilling assembly 10 is used to drill a borehole, drilling fluid is pumped down the drill string from the surface, through the drilling assembly 10, and flows through the annular flow path 133 to the turbine 16. This rotates the turbine drive shaft 40 within the bearing pack 124, and the pressure force exerted upon the oil in the oil reservoir 144 by the piston 138 and compression spring 146 causes the oil to be pressurised to a pressure above the ambient pressure of the drilling fluid outside the sealed chamber 132. This overpressurising of the oil in the chamber 132 causes a positive, dynamic displacement of oil from the sealed chamber 132. This prevents ingress of drilling fluid into the sealed chamber 132, where it would contaminate the lubricating oil, and where the abrasive particles in the drilling fluid would quickly cause wear of the bearings 126, leading to failure of the bearing unit 14. The pressure of the oil is sufficient to cause displacement of oil from the chamber 132, without being large enough to damage, in particular, any of the seals. Thus, the pressure differential between the oil and the drilling fluid is relatively small, and is sufficient simply to cause oil displacement. Thus, as the chamber 132 is sealed locally by seals 142 and 162 and as the pressure differential is relatively small, these seals are not susceptible to fluctations in pressure drop across the drill bit 26 for example, when drilling in different formations.

The displacement of oil from the sealed chamber 132 occurs dynamically (that is, only in use of the drilling assembly) from a lower mechanical seal assembly 162, which will be described in more detail below. Leakage of oil from the sealed chamber 132 causes the level of oil in the oil reservoir 144 to slowly decrease. The volume of oil provided in the oil reservoir 144 is predetermined such that an operating lifetime of the bearing unit can be calculated, based upon the oil leakage during operation. This allows the tool to be pulled from the borehole, and the bearing unit 14 to be broken out, such that the oil in the oil reservoir may be replenished through a valve 164 of the piston 138.

The valve 164 includes a plug 1-66 and a ball valve 168, of a type known in the art, biassed by a biassing spring 170 and by oil pressure in the chamber 132 against a valve seat 172. It will be understood that for oil replenishment, the plug 166 is removed and the ball valve 168 moved to compress the biassing spring 170, allowing oil to be injected into the oil reservoir 144 through an oil passage 174.

The compression spring 146 is arranged to provide a substantially constant spring force upon the piston 138, such that a substantially constant pressure force is applied to the oil in the sealed chamber 132 as the oil level in reservoir 144 falls, and the piston 138 moves axially towards the bearing pack 124.

Figure 3B:
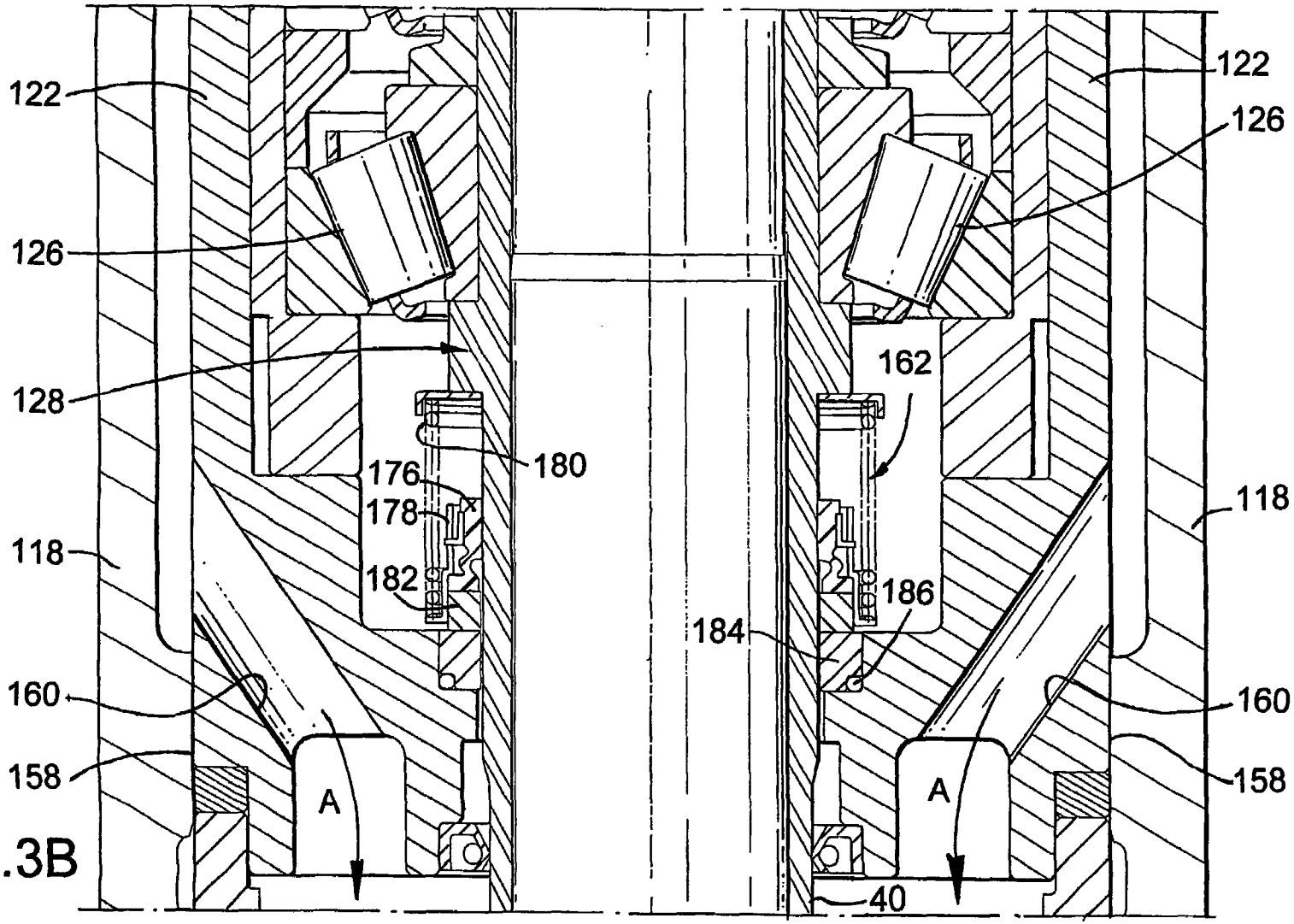
FIG. 3B is a further enlarged view of part of the sealing assembly and bearing mechanism of FIG. 3A.

Referring now to FIG. 3B, there is shown a further enlarged view of the bearing unit 14, showing the lower mechanical seal assembly 162 in more detail. The mechanical seal assembly 162 is a component well known in the art and comprises a compressible bellows 176, typically of an elastomeric or metal material, carrying an annular bracket 178 which supports a compression spring 180. However, other suitable mechanical seal assemblies may equally be employed. The bellows 176 is fixed to the upper end 128 of turbine drive shaft 14 for rotation therewith, and has an annular sealing disc 182 coupled to the bellows 176, to rotate with the drive shaft 40 and bellows 176.

The compression spring 180 urges the drive shaft 40, bellows 176 and disc 182 into engagement with a second annular sealing disc 184, mounted to the inner sleeve 122 and including an elastomeric O-ring seal 186. The second disc 184 is, during operation of the drilling assembly 10, stationary with respect to the inner sleeve 122, whilst the disc 182 rotates with the drive shaft 40. This allows leakage of the oil from the oil reservoir 144 between the discs 182, 184 at a controlled rate, to prevent the ingress of drilling fluid as discussed above. The lip seal 142 provided on the piston 138 fluidly seals the chamber 132, such that the only leakage occurs dynamically from the mechanical seal assembly 162.

Figure 4A:
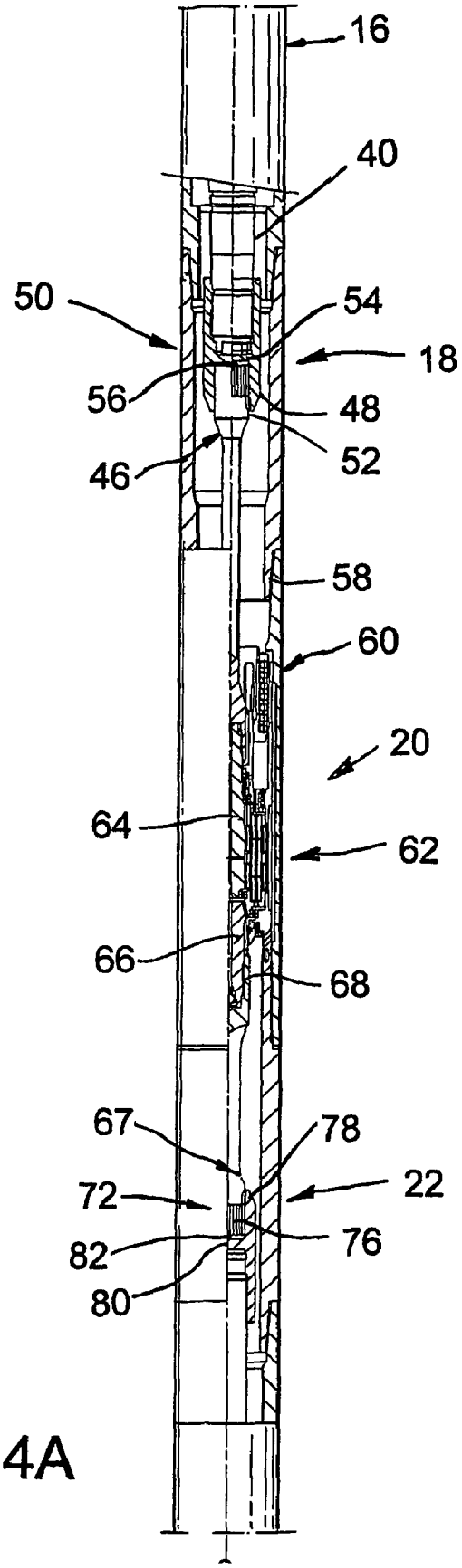
FIG. 4A is an enlarged, longitudinal, partially half-sectional view of a sealing assembly and a gear mechanism incorporating the sealing assembly, as well as a substantially shock eliminating coupling assembly, forming part of the drilling assembly of FIGS. 1 to 2H.

Referring now to FIG. 4A, there is shown an enlarged, longitudinal, partially half-sectional view of the gear mechanism 20, incorporating the sealing assembly 60, which is substantially identical to the sealing assembly 116 of the first bearing unit 14. The view of FIG. 4A also illustrates the substantially shock eliminating coupling assemblies 18 and 22 discussed above with reference to FIGS. 2D and 2E in more detail, with the first coupling assembly 18 shown in full section view for clarity.

Figure 4B:
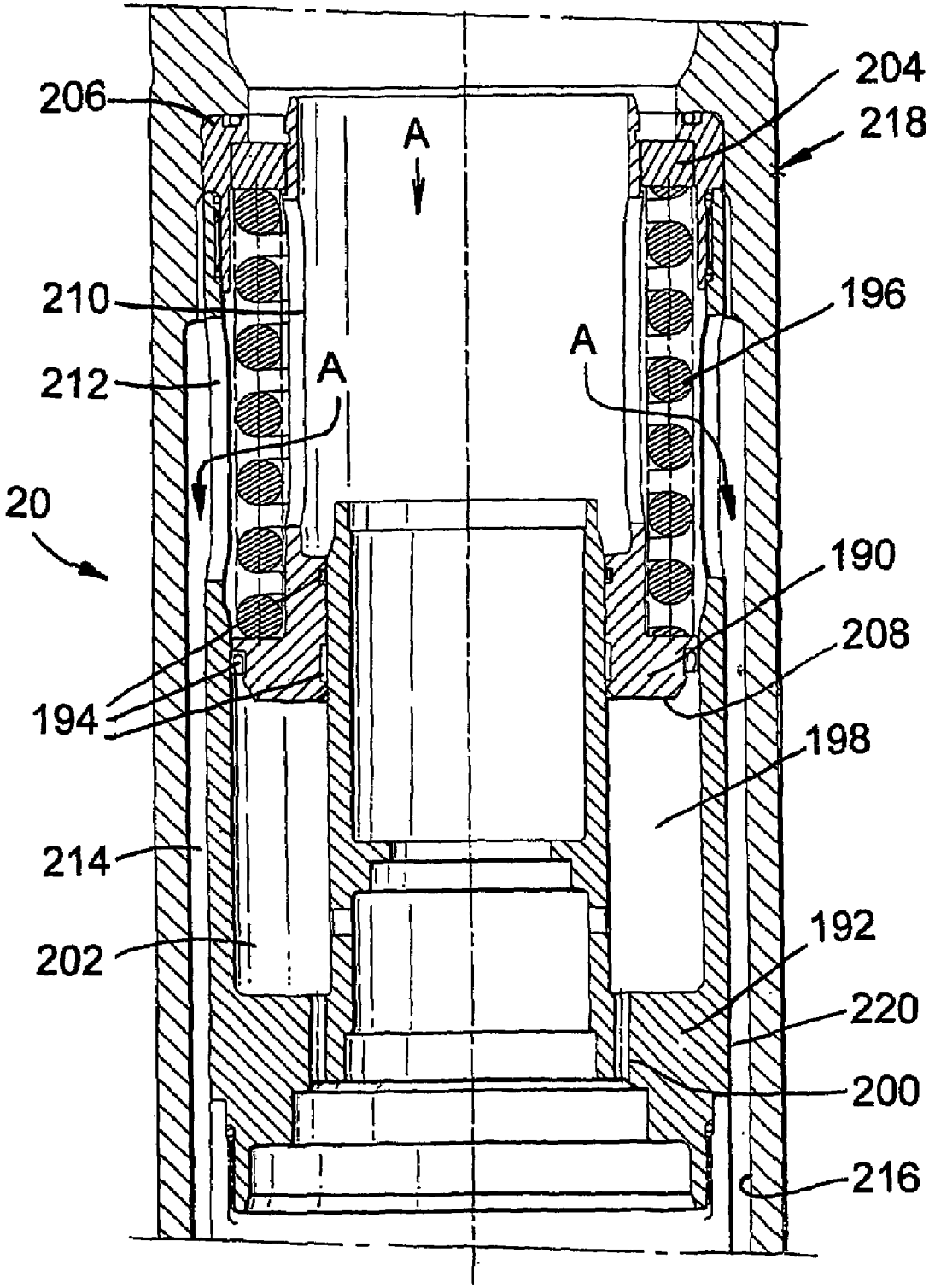
FIGS. 4B to 4D are further enlarged views of part of the sealing assembly and gear mechanism of FIG. 4A.
Figure 4C:
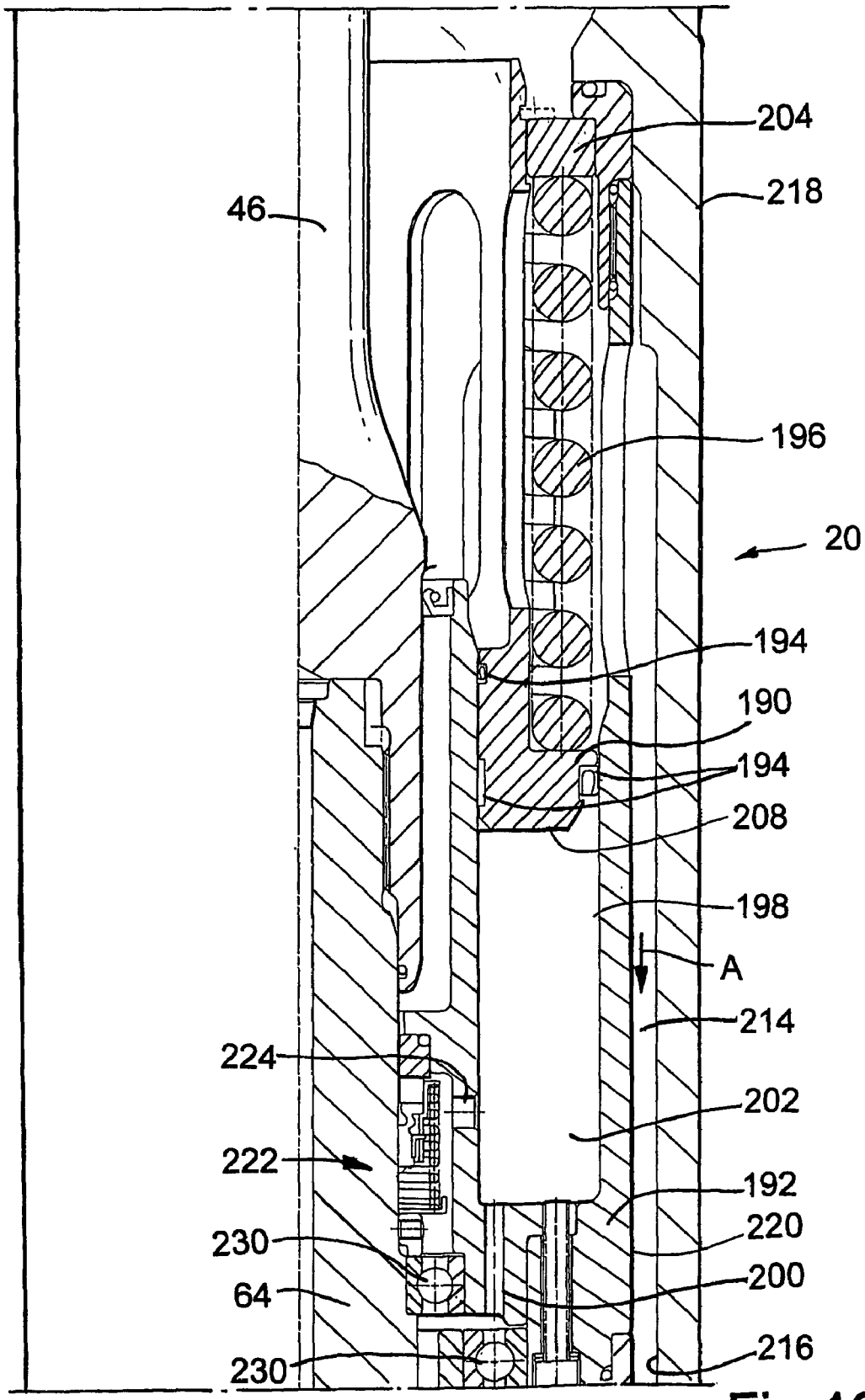
Figure 4D:
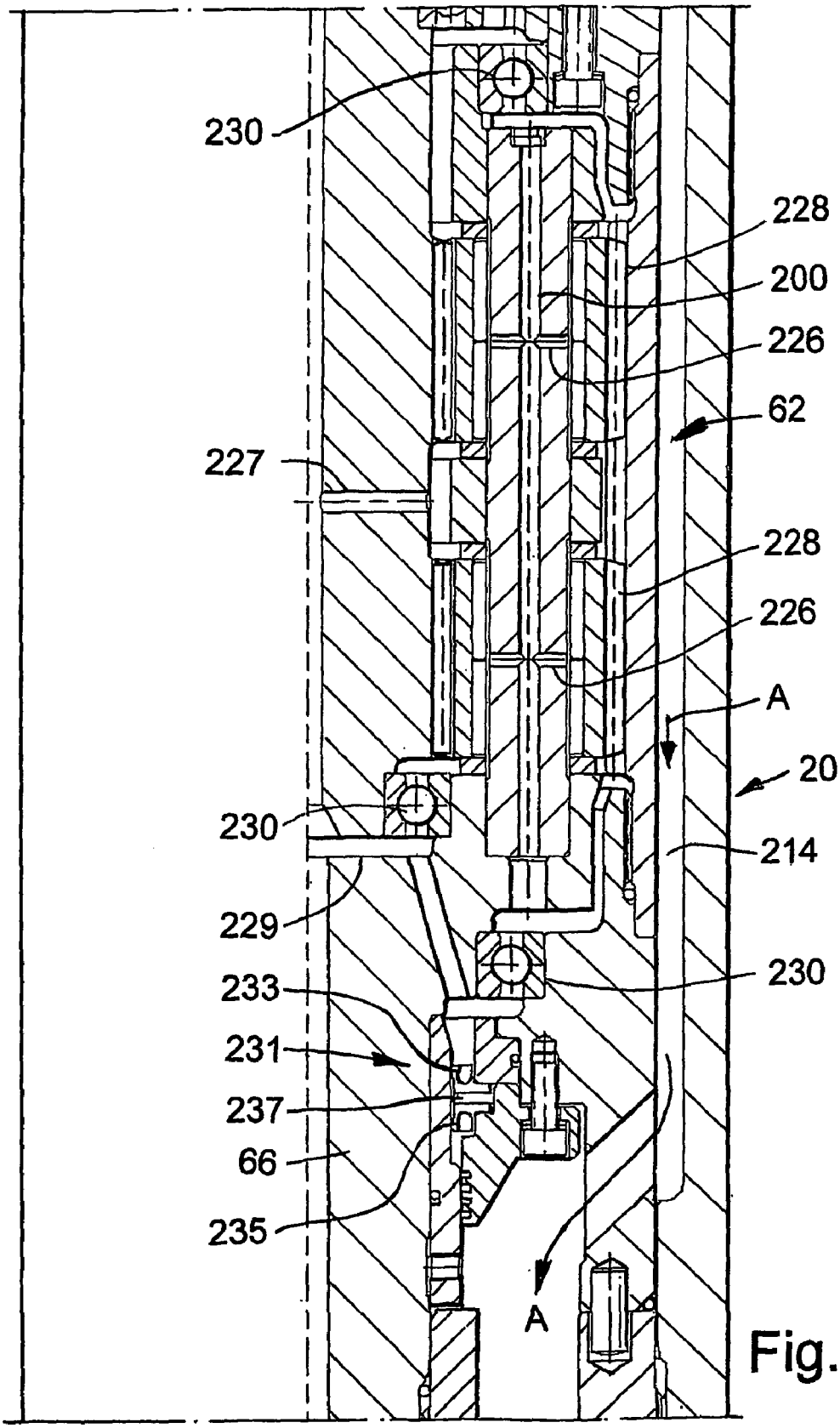

FIGS. 4B to 4D are further enlarged views of the sealing assembly 60, and the gear mechanism 20 of FIG. 4A. Referring initially to FIG. 4B, it will be noted that the sealing assembly 60 includes an axially movable piston 190 mounted in a hydraulic cylinder housing 192 of the gear mechanism 20, the piston 190 carrying elastomeric lip seals 194 for sealing the piston 190 to the housing 192. A compression spring 196 biases the piston 190 to pressurise oil in a sealed chamber 198 of the gear mechanism 20, which contains lubricating oil for the gearing 62 (not shown in FIG. 4B). Flow ports 200 are provided for connecting an oil reservoir 202 to the gearing 62. The spring 196 is located between an upper annular plate 204 secured against a shoulder 206 of the housing 192 and a piston head 208 of the piston 190. The piston 190 includes a number of axially extending slots 210 through which drilling fluid flowing through the drilling assembly 10 may pass, in the direction of the arrows A shown in FIG. 4B.

The drilling fluid passes between coils of the spring 196 and matching slots 212 formed in the housing 192, before entering an annular flow path 214 defined between an inner surface 216 of a gear mechanism housing 218 and an outer surface 220 of the housing 192, in a similar fashion to the flow path 133 of the bearing unit 14. It will be appreciated that the gear mechanism 20 shown in FIG. 4B is shown without the gear mechanism input and output shafts 46 and 64 for clarity.

Turning now to FIG. 4C, the gear mechanism 20 is shown in a view similar to that of FIG. 4B, in half longitudinal section, and showing the input shaft 46 and main sun gear shaft 64. It will be seen that the gear mechanism 20 includes a mechanical seal assembly 222 substantially identical to the mechanical seal assembly 162 of the bearing unit 14, and this allows for positive displacement of oil from the sealed chamber 198 through flow ports 224. Referring in addition to FIG. 4D, there is shown a view similar to that of FIG. 4C, of the lower part of the gear mechanism 20 including the gearing 62. As mentioned above, the gearing 62 is lubricated by oil in the sealed chamber 198 supplied through the flow ports 200, which supply oil via branches 226 to planetary gears 228 of the gearing 62. Spherical roller bearings 230 of the gearing 62 are also lubricated by the lubricating oil.

Also, oil is supplied to lubricate the planetary gear carrier 66 through flow ports 227 and 229. A polymeric lip seal 231 is provided below the bearings 230, to act as a barrier to prevent the ingress of drilling fluid, and comprises upper and lower generally T-shaped annular elements 233 and 235. The upper element 233 allows oil to leak through into a gap 237 defined between the elements, to prevent drilling fluid from entering the sealed gear mechanism 20, whilst the lower element 235 is lubricated by drilling fluid.

Figure 5A:
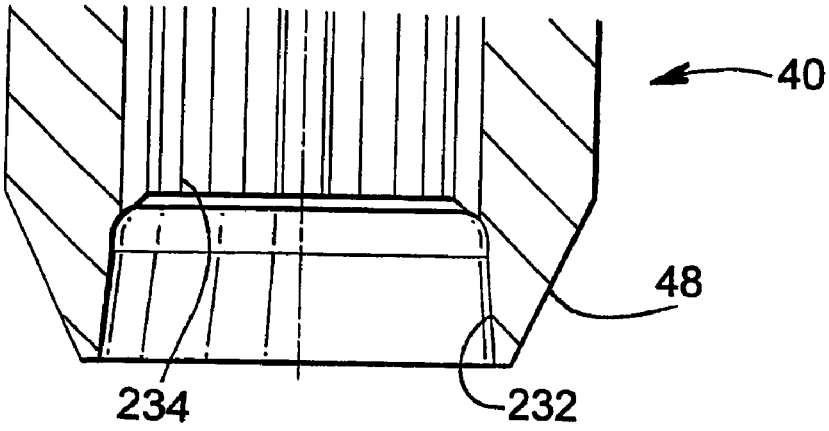
FIGS. 5A to 5C are sectional, end and enlarged views of part of an end of a typical splined connection, such as may form part of the coupling assembly of FIG. 4A.
Figure 5B:
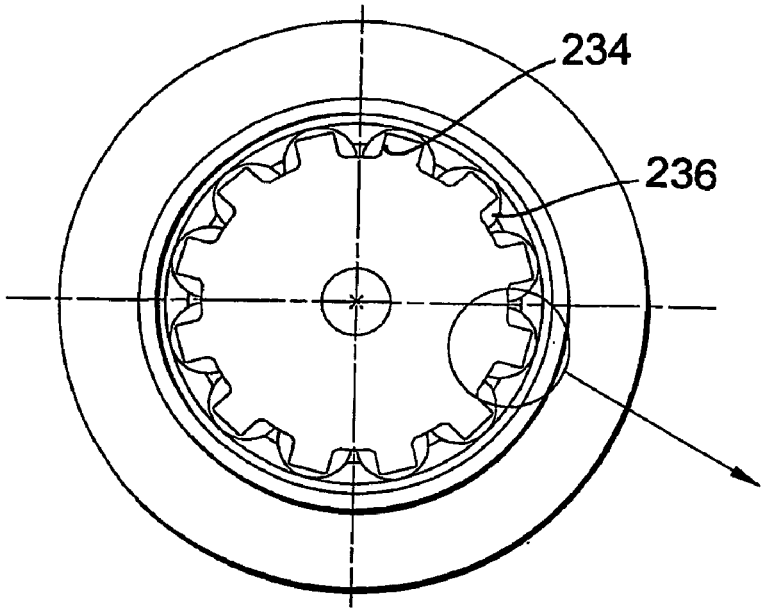
Figure 5C:
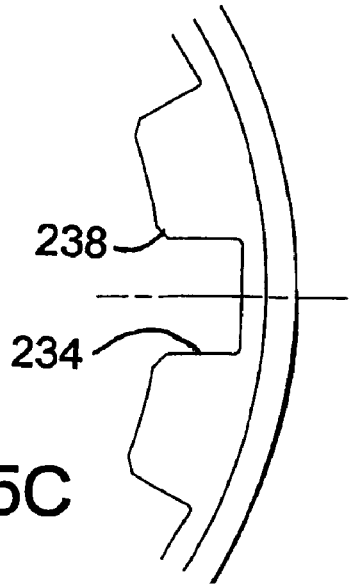

Referring now to FIGS. 5A to 5C, there are shown sectional, end and enlarged views of part of an end of a typical splined connection, such as those forming part of the substantially shock eliminating coupling assemblies 18 and 22. By way of example, the lower end 48 of the turbine drive shaft 40 is shown in FIGS. 5A to 5C. The lower end 48 includes an opening 232 carrying internal female splines 234, adapted to receive mating external male splines formed on the upper end 52 of the gear mechanism input shaft 46, shown in FIG. 2D. As will be noted from FIG. 5B and FIG. 5C, which is an enlarged view of the splines shown in FIG. 5B, the female splines 234 are substantially square in cross-section, and have chamfered ends 236 to facilitate connection with the male splines of the shaft 46. The splines 234 extend a determined length along the shaft 40, to allow for axial movement between the shafts 40 and 46, as discussed above. It will also be noted that the splines 234 are chamfered at 238, again to facilitate engagement with male splines on the shaft 46.

Figure 6A:
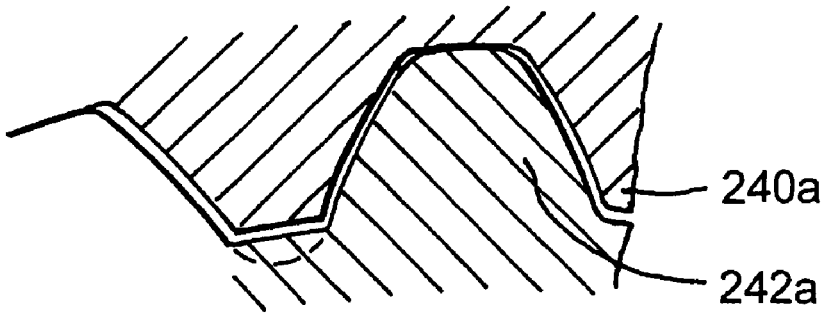
FIGS. 6A to 6C are profile views of alternative spline profiles of the splined connection of FIGS. 5A to 5C.
Figure 6B:
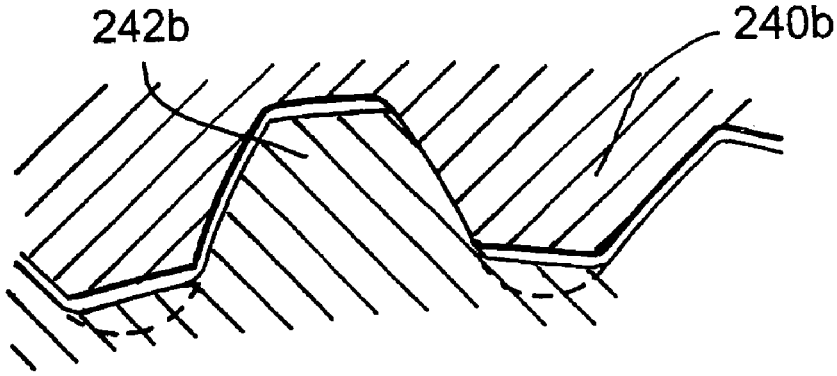
Figure 6C:
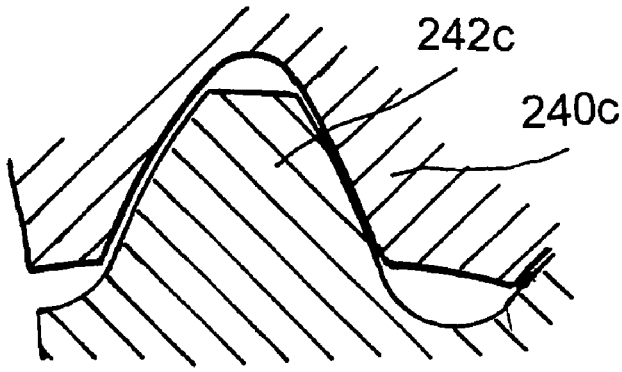

Turning now to FIGS. 6A to 6C, there are shown alternative spline profiles to those of the splines 234 shown in FIGS. 5A to 5C. Female splines 240*a* and male splines 242*a* are shown in FIG. 6A, which are involute splines of different profile to the splines 234 of FIGS. 5A to 5C. FIGS. 6B and 6C shown further alternative involute spline types, FIG. 6B showing female splines 240*b* and male splines 242*b*, and FIG. 6C showing female splines 240*c* and males splines 242*c*. It will be appreciated that any spline profile type suitable for providing the shock absorbing coupling assembly may be chosen.

It will be understood that the present invention, in providing a bearing mechanism separate from a gear mechanism, is particularly advantageous in that this isolates the gear mechanism from vibration and heat generated by the bearing mechanism in use.

It will also be understood that the present invention is further particularly advantageous in that the tool assemblies of the drilling assembly, in particular the gear mechanism, are easily broken out on the rig floor and are therefore rig floor replaceable with the minimum of disruption to a drilling operation.

Various modifications may be made to the foregoing within the scope of the present invention.

For example, a single bearing mechanism may be provided, separately from the gear mechanism, to absorb both hydraulic and mechanical loads. The bearing mechanism may, instead of being provided with the turbine, be provided as a separate unit located in a desired position in the drilling assembly. The drilling fluid may be air, Nitrogen foam or any other suitable drilling fluid.

The sealing assembly may be a sealing assembly for any other downhole tool or part thereof requiring sealing. Indeed, the sealing assembly may be for any body requiring sealing from entry of an external fluid, such as tools or the like located in gas or oil pipelines or other fluid flow lines.

Particular types of seals have been discussed for use with the various tool assemblies of the drilling assembly. It will be appreciated that any suitable type of mechanical or static seal, where appropriate, may be utilised, according to the particular tool assembly requirements.

An assembly for location in a hollow body for transferring a rotational drive force therethrough may be provided, with a gear mechanism isolated from a bearing mechanism of the assembly. Such may include a pump or the like.

Any suitable alternative rotational drive unit may be employed, such as a PDM or electric motor.

The gear mechanism, which, as discussed, is fully rig floor replaceable, may include separate gear units. In particular, the gear mechanism may include two or more separate gear units, where the number of gear units is selected according to the desired output torque and shaft rotational velocity. The ability of the gear mechanism (and thus of such separate gear units) to be broken out on the rig floor allows the number of gear units to be readily altered, in contrast with prior art systems, where gear mechanisms are not readily broken out. Furthermore, the output torque and shaft velocity can only be changed, in such systems, by varying the gear arrangement. This is a workshop operation and cannot be carried out on the rig floor. It will be understood that the gear units would be coupled by floating axial couplings, and thus easily separable.

Also, the drilling assembly may be suitable for deviated or directional drilling operations, and may therefore include a bent housing assembly, an adjustable bend housing assembly or the like, of a type known in the art. Such assemblies are ideally located as close to the drill bit as possible, and thus would typically be provided as part of or in the vicinity of the lower bearing unit, between the gear mechanism and bit. Thus the lower bearing unit may carry a fixed bent housing or an adjustable bend housing.

The invention claimed is:

1. A drilling assembly for a well, the drilling assembly comprising:

a drill bit;

a rotational drive unit for generating a rotational drive force;

a gear mechanism coupled to said drive unit and to said drill bit, said gear mechanism contained in a gear housing;

a drive shaft for transferring the rotational drive force through said gear mechanism to said drill bit; and a bearing mechanism comprising a bearing unit providing bearings, said bearing unit being separably couplable to said gear mechanism, said bearing unit being, in use, positioned above and coupled relative to said gear mechanism such that said bearing unit is longitudinally spaced from an end of said gear housing and so as to act to prevent transmission of axially directed hydraulic loads experienced by said bearing unit through the drive shaft to the gear mechanism.

2. A drilling assembly as claimed in claim 1, wherein said bearing unit is a first bearing unit, and the bearing mechanism comprises a second bearing unit coupled relative to the gear mechanism so as to act to prevent transmission of axially directed mechanical loads experienced by the second bearing unit from the drill bit through the drive shaft to the gear mechanism.

3. A drilling assembly as claimed in claim 1, comprising at least one substantially shock eliminating coupling assembly which acts to prevent transmission of axially directed loads experienced by the bearing mechanism to the gear mechanism.

4. A drilling assembly as claimed in claim 3, wherein the substantially shock eliminating coupling assembly is an axially floating coupling.

5. A drilling assembly as claimed in claim 4, wherein the axially floating coupling comprises an axially floating shaft.

6. A drilling assembly as claimed in claim 1, wherein the gear mechanism is sealed with respect to the bearing mechanism.

7. A drilling assembly as claimed in claim 2, wherein the drilling assembly includes a first shock eliminating coupling assembly between the first bearing unit and the gear mechanism and a second shock eliminating coupling assembly between the gear mechanism and the drill bit.

8. A drilling assembly as claimed in claim 7, wherein the first bearing unit is provided above the rotational drive unit.

9. A drilling assembly as claimed in claim 7, wherein the second bearing unit is provided between the drill bit and the gear mechanism.

10. A drilling assembly as claimed in claim 1, wherein the gear mechanism and at least part of the bearing mechanism are provided in a single assembly part.

11. A drilling assembly as claimed in claim 10, wherein the gear mechanism and said part of the bearing mechanism are mounted separately in a single housing of the drilling assembly.

12. A drilling assembly as claimed claim 1, wherein the gear mechanism and at least part of the bearing mechanism are provided in separate assembly parts, said assembly part of the bearing mechanism comprising at least said bearing unit.

13. A drilling assembly as claimed in claim 12, wherein the gear mechanism and said bearing unit comprise separate respective housings of the drilling assembly.

14. A drilling assembly as claimed in claim 1, wherein said bearing unit is adapted to absorb both hydraulic loads due to fluid passing through the drilling assembly to the drill bit and mechanical loads transmitted from the drill bit.

15. A drilling assembly as claimed in claim 1, wherein at least part of the bearing mechanism is provided integrally with the rotational drive unit.

16. A drilling assembly as claimed in claim 1, wherein the bearing mechanism is sealed from the ingress of fluid from the drilling assembly, and is lubricated by a lubricating fluid which is pressurised to a pressure greater than the ambient pressure of fluid within the drilling assembly.

17. A drilling assembly as claimed in claim 1, wherein the gear mechanism is sealed from ingress of fluid from the drilling assembly, and lubricated by a lubricating fluid which is pressurised to a pressure greater than the ambient pressure of fluid within the drilling assembly.

18. A drilling assembly as claimed in claim 16, wherein the lubricating fluid is at a pressure great enough to promote dynamic bleed of the lubricating fluid from the mechanism, but low enough to prevent seal failure.

19. A bearing mechanism for a drilling assembly, the bearing mechanism comprising a bearing unit providing bearings, said bearing unit being separably couplable to a gear mechanism of the drilling assembly, said bearing unit being, in use, positioned above and coupled relative to said gear mechanism such that said bearing unit is longitudinally spaced from an end of a gear housing of said gear mechanism and so as to act to prevent transmission of axially directed hydraulic loads experienced by said bearing unit through a drive shaft of the drilling assembly to the gear mechanism.

20. A turbine power unit for a drilling assembly adapted to be located in a well, the turbine power unit including a turbine for generating a rotational drive force for the drilling assembly, and a bearing mechanism comprising a bearing unit providing bearings, said bearing unit being separably couplable to a gear mechanism of the drilling assembly, said bearing unit being, in use, positioned above and coupled relative to said gear mechanism such that said bearing unit is longitudinally spaced from an end of a gear housing of said gear mechanism and so as to act to prevent transmission of axially directed hydraulic loads experienced by said bearing unit through a drive shaft of the drilling assembly to the gear mechanism.

21. A drilling assembly for location in a hollow body and for transferring a rotational drive force therethrough, the assembly comprising:

a rotational drive unit through which the rotational drive force is transferred;

a gear mechanism coupled to the drive unit and to a rotatable member;

a drive shaft for transferring the rotational drive force between the rotational drive unit and the rotatable member; and a bearing mechanism comprising a bearing unit providing bearings, said bearing unit being separably couplable to the gear mechanism, said bearing unit being, in use, positioned above and coupled relative to the gear mechanism such that said bearing unit is longitudinally spaced from an end of a gear housing of said gear mechanism and so as to act to prevent transmission of axially directed hydraulic loads experienced by said bearing unit through the drive shaft to the gear mechanism.

22. An assembly as claimed in claim 21, wherein the rotational drive unit comprises a turbine.

23. An assembly as claimed in claim 21, wherein the rotational drive unit comprises a Positive Displacement Motor (PDM).

24. An assembly as claimed in claim 21, wherein the rotational drive unit comprises a pump and the rotatable members comprise a motor shaft.

25. A drilling assembly as claimed in claim 1, wherein, in use, said bearing unit is provided above the rotational drive unit.

26. A drilling assembly as claimed in claim 1, wherein the rotational drive unit comprises a turbine.

* * * * *